US010741376B2

(12) United States Patent
Hoyes et al.

(10) Patent No.: US 10,741,376 B2
(45) Date of Patent: Aug. 11, 2020

(54) MULTI-REFLECTING TOF MASS SPECTROMETER

(71) Applicants: Micromass UK Limited, Wilmslow (GB); LECO Corporation, St. Joseph, MI (US)

(72) Inventors: John Brian Hoyes, Stockport (GB); Keith Richardson, High Peak (GB); Anatoly Verenchikov, Wilmslow (GB); Mikhail Yavor, St Petersburg (RU)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/570,537

(22) PCT Filed: Apr. 29, 2016

(86) PCT No.: PCT/GB2016/051238

§ 371 (c)(1),
(2) Date: Oct. 30, 2017

(87) PCT Pub. No.: WO2016/174462

PCT Pub. Date: Nov. 3, 2016

(65) Prior Publication Data

US 2018/0144921 A1 May 24, 2018

(30) Foreign Application Priority Data

Apr. 30, 2015 (GB) ..... 1507363.8

(51) Int. Cl.
*H01J 49/40* (2006.01)
*H01J 49/42* (2006.01)
(Continued)

(52) U.S. Cl.
CPC ..... *H01J 49/406* (2013.01); *H01J 49/0031* (2013.01); *H01J 49/061* (2013.01);
(Continued)

(58) Field of Classification Search
None
See application file for complete search history.

(56) References Cited

U.S. PATENT DOCUMENTS 4,731,532 A 3/1988 Frey et al.
5,017,780 A 5/1991 Kutscher et al.
(Continued)

FOREIGN PATENT DOCUMENTS

CN 101369510 A 2/2009
CN 102131563 A 7/2011
(Continued)

OTHER PUBLICATIONS

Search Report Under Section 17(5) for Application No. GB1507363.8 dated Nov. 9, 2015.
(Continued)

*Primary Examiner* — Michael J Logie

(57) ABSTRACT

A method of time-of-flight mass spectrometry is disclosed comprising: providing two ion mirrors (42) that are spaced apart in a first dimension (X-dimension) and that are each elongated in a second dimension (Z-dimension) orthogonal to the first dimension; introducing packets of ions (47) into the space between the mirrors using an ion introduction mechanism (43) such that the ions repeatedly oscillate in the first dimension (X-dimension) between the mirrors (42) as they drift through said space in the second dimension (Z-dimension); oscillating the ions in a third dimension (Y-dimension) orthogonal to both the first and second dimensions as the ions drift through said space in the second dimension (Z-dimension); and receiving the ions in or on an ion receiving mechanism (44) after the ions have oscillated multiple times in the first dimension (X-dimension); wherein
(Continued)

at least part of the ion introduction mechanism (43) and/or at least part of the ion receiving mechanism (44) is arranged between the mirrors (42).

20 Claims, 12 Drawing Sheets

(51) Int. Cl.
*H01J 49/00* (2006.01)
*H01J 49/06* (2006.01)

(52) U.S. Cl.
CPC ..... *H01J 49/405* (2013.01); *H01J 49/426* (2013.01); *H01J 49/4245* (2013.01)

(56) References Cited

U.S. PATENT DOCUMENTS 5,128,543 A 7/1992 Reed et al.
5,619,034 A 4/1997 Reed et al.
5,654,544 A 8/1997 Dresch
5,955,730 A 9/1999 Kerley et al.
6,013,913 A 1/2000 Hanson
6,020,586 A 2/2000 Dresch et al.
6,107,625 A 8/2000 Park
6,316,768 B1 11/2001 Rockwood et al.
6,384,410 B1 5/2002 Kawato
6,469,295 B1 10/2002 Park
6,489,610 B1 12/2002 Barofsky et al.
6,570,152 B1 5/2003 Hoyes
6,627,877 B1 9/2003 Davis et al.
6,717,132 B2 4/2004 Franzen
6,744,042 B2 6/2004 Zajfman et al.
6,888,130 B1 5/2005 Gonin
6,949,736 B2 9/2005 Ishihara
7,034,292 B1 4/2006 Whitehouse et al.
7,196,324 B2 3/2007 Verentchikov
7,326,925 B2 2/2008 Verentchikov et al.
7,351,958 B2 4/2008 Vestal
7,385,187 B2 6/2008 Verentchikov et al.
7,501,621 B2 3/2009 Willis et al.
7,504,620 B2 3/2009 Sato et al.
7,582,864 B2 9/2009 Verentchikov
7,663,100 B2 2/2010 Vestal
7,709,789 B2 5/2010 Vestal et al.
7,772,547 B2 * 8/2010 Verentchikov ..... H01J 49/406 250/287
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,989,759 B2 8/2011 Holle
8,017,907 B2 9/2011 Willis et al.
8,063,360 B2 11/2011 Willis et al.
8,373,120 B2 2/2013 Verentchikov
8,395,115 B2 3/2013 Makarov et al.
8,637,815 B2 1/2014 Makarov et al.
8,642,951 B2 2/2014 Li
8,658,984 B2 2/2014 Makarov et al.
8,835,839 B1 9/2014 Anderson et al.
8,853,623 B2 10/2014 Verenchikov
8,901,490 B1 12/2014 Chen et al.
8,907,273 B1 12/2014 Chen et al.
8,921,772 B2 12/2014 Verenchikov
9,082,597 B2 7/2015 Willis et al.
9,082,604 B2 7/2015 Verenchikov
9,214,322 B2 12/2015 Kholomeev et al.
9,312,119 B2 4/2016 Verenchikov
9,373,490 B1 6/2016 Nishiguchi
9,396,922 B2 7/2016 Verenchikov et al.
9,425,034 B2 8/2016 Verentchikov et al.
9,472,390 B2 10/2016 Verenchikov et al.
9,595,431 B2 3/2017 Verenchikov
9,683,963 B2 6/2017 Verenchikov
9,728,384 B2 8/2017 Verenchikov
9,779,923 B2 10/2017 Verenchikov
9,786,484 B2 10/2017 Willis et al.
9,865,445 B2 1/2018 Verenchikov et al.
9,870,906 B1 1/2018 Quarmby et al.
9,881,780 B2 1/2018 Verenchikov et al.
2001/0011703 A1 8/2001 Franzen
2001/0035498 A1 11/2001 Li et al.
2002/0190199 A1 12/2002 Li
2003/0111597 A1 6/2003 Gonin et al.
2004/0084613 A1 5/2004 Bateman et al.
2004/0108453 A1 6/2004 Kobayashi et al.
2004/0119012 A1 6/2004 Vestal
2004/0155187 A1 8/2004 Axelsson
2005/0040326 A1 2/2005 Enke
2005/0103992 A1 5/2005 Yamaguchi et al.
2005/0133712 A1 6/2005 Belov et al.
2005/0258364 A1 11/2005 Whitehouse et al.
2006/0169882 A1 8/2006 Pau et al.
2006/0214100 A1 * 9/2006 Verentchikov ..... H01J 49/406 250/287
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0290269 A1 11/2008 Saito et al.
2009/0206250 A1 8/2009 Wollnik
2009/0272890 A1 11/2009 Ogawa et al.
2010/0072363 A1 3/2010 Giles et al.
2010/0140469 A1 6/2010 Nishiguchi
2010/0193682 A1 * 8/2010 Golikov ..... H01J 49/406 250/287
2010/0301202 A1 12/2010 Vestal
2011/0133073 A1 6/2011 Sato et al.
2011/0168880 A1 7/2011 Ristroph et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2013/0048852 A1 2/2013 Verenchikov
2013/0056627 A1 * 3/2013 Verenchikov ..... H01J 49/406 250/282
2013/0068942 A1 * 3/2013 Verenchikov ..... H01J 49/4245 250/282
2013/0187044 A1 7/2013 Ding et al.
2013/0240725 A1 9/2013 Makarov
2013/0248702 A1 9/2013 Makarov
2013/0313424 A1 * 11/2013 Makarov ..... H01J 49/406 250/282
2013/0327935 A1 12/2013 Wiedenbeck
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0239172 A1 8/2014 Makarov
2014/0291503 A1 10/2014 Shchepunov et al.
2014/0361162 A1 12/2014 Murray et al.
2015/0028197 A1 1/2015 Grinfeld et al.
2015/0028198 A1 * 1/2015 Grinfeld ..... H01J 49/06 250/282
2015/0048245 A1 2/2015 Vestal et al.
2015/0060656 A1 3/2015 Ugarov
2015/0122986 A1 5/2015 Haase
2015/0228467 A1 8/2015 Grinfeld et al.
2015/0279650 A1 10/2015 Verenchikov
2015/0294849 A1 10/2015 Makarov et al.
2015/0318156 A1 11/2015 Loyd et al.
2015/0380233 A1 12/2015 Verenchikov
2016/0079052 A1 3/2016 Maakarov
2016/0225598 A1 8/2016 Ristroph
2016/0225602 A1 8/2016 Ristroph et al.
2016/0240363 A1 8/2016 Verenchikov
2017/0025265 A1 1/2017 Verenchikov et al.

(56) References Cited

U.S. PATENT DOCUMENTS

| | | | |
|---|---|---|---|
| 2017/0032952 | A1 | 2/2017 | Verenchikov |
| 2017/0098533 | A1 | 4/2017 | Stewart et al. |
| 2017/0338094 | A1* | 11/2017 | Verenchikov ..... H01J 49/406 |

FOREIGN PATENT DOCUMENTS

| | | | |
|---|---|---|---|
| DE | 10116536 | A | 10/2002 |
| EP | 0237259 | A2 | 9/1987 |
| EP | 1137044 | A2 | 9/2001 |
| EP | 2068346 | A2 | 6/2009 |
| EP | 2599104 | A1 | 6/2013 |
| GB | 2080021 | A | 1/1982 |
| GB | 2217907 | A | 11/1989 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| JP | 2003-031178 | A | 1/2003 |
| JP | 3571546 | B2 | 9/2004 |
| JP | 2005-538346 | A | 12/2005 |
| JP | 2006049273 | A | 2/2006 |
| JP | 2007227042 | A | 9/2007 |
| JP | 2010-062152 | A | 3/2010 |
| JP | 4649234 | B2 | 3/2011 |
| JP | 2013-539590 | A | 10/2013 |
| JP | 2015-506567 | A | 3/2015 |
| RU | 2564443 | C2 | 10/2015 |
| RU | 2015148627 | A | 5/2017 |
| RU | 2660655 | C2 | 7/2018 |
| SU | 1725289 | A1 | 4/1992 |
| WO | 1998001218 | A1 | 1/1998 |
| WO | 2000/77823 | A2 | 12/2000 |
| WO | 2005001878 | A2 | 1/2005 |
| WO | 2006102430 | A2 | 9/2006 |
| WO | 2007044696 | A1 | 4/2007 |
| WO | 2007/104992 | A2 | 9/2007 |
| WO | 2007/136373 | A1 | 11/2007 |
| WO | 2010008386 | A1 | 1/2010 |
| WO | 2010014077 | A1 | 2/2010 |
| WO | 2013045428 | A1 | 3/2011 |
| WO | 2011086430 | A1 | 7/2011 |
| WO | 2011107836 | A1 | 9/2011 |
| WO | 2011135477 | A1 | 11/2011 |
| WO | 2012/010894 | A1 | 1/2012 |
| WO | 2012024468 | A2 | 2/2012 |
| WO | 2012116765 | A1 | 9/2012 |
| WO | 2013063587 | A2 | 5/2013 |
| WO | 2013067366 | A2 | 5/2013 |
| WO | 2013093587 | A1 | 6/2013 |
| WO | 2013098612 | A1 | 7/2013 |
| WO | 13124207 | A | 8/2013 |
| WO | 2013110587 | A2 | 8/2013 |
| WO | 2013110588 | A2 | 8/2013 |
| WO | 2014021960 | A1 | 2/2014 |
| WO | 2014074822 | A1 | 5/2014 |
| WO | 2014110697 | A1 | 7/2014 |
| WO | 2014142897 | A1 | 9/2014 |
| WO | 2015142897 | A1 | 9/2015 |
| WO | 2015152968 | A1 | 10/2015 |
| WO | 2015153630 | A1 | 10/2015 |
| WO | 2015153644 | A1 | 10/2015 |
| WO | 2015191569 | A1 | 12/2015 |
| WO | 2016064398 | A1 | 4/2016 |
| WO | 2016174462 | A1 | 11/2016 |
| WO | 2018/073589 | A1 | 4/2018 |
| WO | 2019/030476 | A1 | 2/2019 |

OTHER PUBLICATIONS

International Search Report and Written Opinion of the International Search Authority for Application No. PCT/GB2016/051238 dated Jul. 12, 2016.

International Search Report and Written Opinion for International Application No. PCT/US2016/062174 dated Mar. 6, 2017, 8 pages.

Doroshenko, V.M., and Cotter, R.J., "Ideal velocity focusing in a reflectron time-of-flight mass spectrometer", American Society for Mass Spectrometry, 10(10):992-999 (1999).

IPRP PCT/US2016/062174 dated May 22, 2018, 6 pages.

Search Report for GB Application No. GB1520130.4 dated May 25, 2016.

International Search Report and Written Opinion for International Application No. PCTIUS2016/062203 dated Mar. 6, 2017, 8 pages.

Communication Relating to the Results of the Partial International Search for International Application No. PCT/ GB2019/01118, dated Jul. 19, 2019, 25 pages.

Search Report for GB Application No. GB1520134.6 dated May 26, 2016.

IPRP PCT/US2016/062203, dated May 22, 2018, 6 pages.

IPRP for application PCT/GB2016/051238 dated Oct. 31, 2017, 13 pages.

International Search Report and Written Opinion for International Application No. PCT/US2016/063076 dated Mar. 30, 2017, 9 pages.

Search Report under Section 17(5) for application GB1707208.3, dated Oct. 12. 2017, 6 pages.

Search Report for GB Application No. 1520540.4 dated May 24, 2016.

IPRP for application PCT/US2016/063076, dated May 29, 2018, 7 pages.

International Search Report and Written Opinion for International Application No. PCT/GB2017/051981 dated Sep. 21, 2017, 9 pages.

Search Report under Section 17 for United Kingdom Application No. GB1611732.7 dated Dec. 9, 2016, 5 pages.

Zuleta et al., "Micromachined Bradbury-Nielsen Gates", Analytical Chemistry, 79(23): 9160-9165, Dec. 1, 2007.

Gerlich, "Inhomogeneous RF fields: A Versatile Tool for the Study of Processes with Slow Ions", State-Selected and State-to-State Ion-Molecule Reaction Dynamics, Part 1: Experiment, Edited by Cheuk- Yiu Ng and Michael Baer, Advances in Chemical Physics Series, vol. 82, pp. 1-176.

IPRP PCT/GB17/51981 dated Jan. 8, 2019, 7 pages.

International Search Report and Written Opinion for International Application No. PCT/GB2018/051206, dated Jul. 12, 2018, 9 pages.

N/a: " Electrostatic lens ," Wikipedia, Mar. 31, 2017 (Mar. 31, 2017), XP055518392, Retrieved from the Intemet:URL: https://en.wikipedia.org/w/index.phptitle=Electrostatic lens oldid=773161674[retrieved on Oct. 24, 2018].

Hussein, O.A. et al., "Study the most favorable shapes of electrostatic quadrupole doublet lenses" , AIP Conference Proceedings, vol. 1815, Feb. 17, 2017 (Feb. 17, 2017), p. 110003.

Supplementary Partial EP Search Report for EP Application No. 16866997.6, dated Jun. 7, 2019.

Yavor, Mi., et al., "High performance gridless ion mirrors for multi-reflection time-of-flight and electrostatic trap mass analyzers", International Journal of Mass Spectrometry, vol. 426, Mar. 2018, pp. 1-11.

Guan S., et al. "Stacked-ring electrostatic ion guide", Journal of the American Society for Mass Spectrometry, Elsevier Science Inc, 7(1)101-106 (1996).

International Search Report and Written Opinion for application No. PCT/GB2018/052104, dated Oct. 31, 2018, 14 pages.

(56) References Cited

OTHER PUBLICATIONS

International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052103, dated Oct. 30, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 6 pages.
Combined Search and Examination Report under Sections 17 and 18(3) for application GB18076265, dated Oct. 29, 2018, 8 pages.
International Search Report and Written Opinion for application No. PCT/GB2018/052099, dated Oct. 10, 2018, 16 pages.
Kozlov, B. et al. "Enhanced Mass Accuracy in Multi-Reflecting TOF MS" WWW.WATERS.COM/ Posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and Instrucmental Schemes" Institute for Analytical Instrucmentation RAS, Saint-Petersburg, (2004).
Yavor, M. I. "Planar Multireflection Time-of-Flight Mass Analyser with Unlimited Mass Range" Institute for Analytical Instrucmentation RAS, Saint-Petersburg, (2004).
Khasin, Y. I. et al. "Initial Experimenatl Studies of a Planar Multireflection Time-of-Flight Mass Spectrometer" Institute for Analytical Instrucmentation RAS, Saint-Petersburg, (2004).
Verenchicov., A. N. et al. "Stability of Ion Motion in Periodic Electrostatic Fields" Institute for Analytical Instrucmentation RAS, Saint-Petersburg, (2004).
Verenchicov., A. N. "The Concept of Mutireflecting Mass Spectrometer for Continuous Ion Sources" Institute for Analytical Instrucmentation RAS, Saint-Petersburg, (2006).
Verenchicov., A. N., et al. "Accurate Mass Measurements for Inerpreting Spectra of atmospheric Pressure Ionization" Institute for Analytical Instrucmentation RAS, Saint-Petersburg, (2006).
Kozlov, B. N. et al., "Experimental Studies of Space Charge Effects in Multireflecting Time-of-Flight Mass Spectrometes" Institute for Analytical Instrucmentation RAS, Saint-Petersburg, (2006).
Kozlov, B. N. et al., "Multireflecting Time-of-Flight Mass Spectrometer With an Ion Trap Source" Institute for Analytical Instrucmentation RAS, Saint-Petersburg, (2006).
Hasin, Y. I., et al., "Planar Time-of-Flight Multireflecting Mass Spectrometer with an Orthogonal Ion Injection Out of Continuous Ion Sources" Institute for Analytical Instrucmentation RAS, Saint-Petersburg, (2006).
Lutvinsky Y. I. et al., "Estimation of Capacity of High Resolution Mass Spectra for Analysis of Complex Mixtures" Institute for Analytical Instrucmentation RAS, Saint-Petersburg, (2006).
Verenchicov., A. N. et al. "Accurate Mass Measurements for Interpreting Spectra of Atmospheric Pressure Ionization" Institute for Analytical Instrucmentation RAS, Saint-Petersburg, (2006).
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Search Report for United Kingdom Application No. GB1613988.3 datd Jan. 5, 2017, 5 pages.
Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999.
Toyoda et al., "Multi-Turn-Time-of-Flight Mass Spectometers with Electrostatic Sectors", Journal of Mass Spectrometry, 38: 1125-1142, Jan. 1, 2003.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Intemet:URL:https://www.etp-ms.com/file-repository/21 [retrieved on Jul. 31, 2019].
Kaufmann, R., et. al., "Sequencing of peptides in a time-of-flight mass spectrometer: evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB20180051320 dated Aug. 1, 2018.
International Search Report and Written Opinion for International Application No. PCT/GB2019/051839 dated Sep. 18, 2019.
International Search Report and Written Opinion for International Application No. PCT/GB2019/051234 dated Jul. 29, 2019.
Combined Search and Examination Report for United Kingdom Application No. GB1901411.7 dated Jul. 31, 2019.
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for International Application No. PCT/EP2017/070508 dated Oct. 16, 2017, 18 pages.
Examination Report for United Kingdom Application No. GB1618980.5, dated Jul. 25, 2019.
Extended European Search Report for EP Patent Application No. 16866997.6, dated Oct. 16, 2019.
International Search Report and Written Opinion for International application No. PCT/GB2020/050209, dated Apr. 28, 2020, 12 pages.
Search Report under Section 17(5) for GB1916445.8, dated Jun. 15, 2020.

* cited by examiner

62

Ion beam FWHM parameters:
Diameter = 1.4 mm;
1.2 deg at $K_Z$ = 18eV

OA at E = 300 V/mm

Ion packets parameters:
TA = 1ns
ΔK = 400 eV, K = 6000 eV

63

64

MR-TOF Resolution at 16 reflections
Flight time = 487.645 us

| | TA = 0 | TA = 1.0ns |
|---|---|---|
| σ, ns | 0.41 ns | 0.5 ns |
| R (50%) | 475,600 | 224,000 |
| R (σ) | 251,000 | 207,000 |
| R (10%) | 160,000 | 115,000 |

MULTI-REFLECTING TOF MASS SPECTROMETER

CROSS-REFERENCE TO RELATED APPLICATION

This application claims priority from and the benefit of United Kingdom patent application No. 1507363.8 filed on 30 Apr. 2015, the entire contents of which are incorporated herein by reference.

FIELD OF THE INVENTION

The present invention relates generally to mass spectrometers and in particular to multi reflecting time-of-flight mass spectrometers (MR-TOF-MS) and methods of their use.

BACKGROUND

A time-of-flight mass spectrometer is a widely used tool of analytical chemistry, characterized by a high speed of analysis in a wide mass range. It has been recognized that multi-reflecting time-of-flight mass spectrometers (MR-TOF-MS) provide a substantial increase in resolving power due to the flight path extension provided by using multiple reflections between ion optical elements. Such extension in flight path requires folding ion paths either by reflecting ions in ion mirrors, e.g., as described in GB 2080021, or by deflecting ions in sector fields, e.g., as described in Toyoda et al., J. Mass Spectrometry 38 (2003) 1125. MR-TOF-MS instruments that use ion mirrors provide an important advantage of larger energy and spatial acceptance due to high-order time-per-energy and time-per-spatial spread ion focusing.

While MR-TOF-MS instruments fundamentally provide an extended flight path and high resolution, they do not conventionally provide adequate sensitivity since the orthogonal accelerators used to inject ions into the flight path cause a drop in duty cycle at small size ion packets and at extended flight times.

SU 1725289 introduced a folded path planar MR-TOF-MS instrument of the type shown in FIG. 1. The instrument comprises two two-dimensional gridless ion mirrors 12 extended along a drift Z-direction for reflecting ions, an orthogonal accelerator 13 for injecting ions into the device, and a detector 14 for detecting the ions. For clarity, throughout this entire text the planar MR-TOF-MS instrument is described in the standard Cartesian coordinate system. That is, the X-axis corresponds to the direction of time-of-flight, i.e. the direction of ion reflections between the ion mirrors. The Z-axis corresponds to the drift direction of the ions. The Y-axis is orthogonal to both the X and Z axes.

Referring to FIG. 1, in use, ions are accelerated by accelerator 13 towards one of the ions mirrors 12 at an inclination angle $\alpha$ to the X-axis. The ions therefore have a velocity in the X-direction and also a drift velocity in the Z direction. The ions are continually reflected between the two ion mirrors 12 as they drift along the device in the Z-direction until the ions impact upon detector 14. The ions therefore follow a zigzag (jigsaw) mean trajectory within the X-Z plane. The ions advance along the Z-direction per every mirror reflection with an increment $Z_R=C*\sin\alpha$, where C is the flight path between adjacent points of reflection in the ion mirrors. However, no ion focusing is provided in the drift Z-direction and so the ion packets diverge in the drift Z-direction. It is theoretically possible to introduce low divergent ion packets between the ion mirrors 12 so as to allow an ion flight path of about 20 m before the ions overlap in the drift Z-direction, thus achieving a mass resolving power between 100000 and 200000. However, in practice it is not possible to inject ions packets into the space between the mirrors 12 that are more than a few millimeters long in the Z-direction without the ions impacting on the orthogonal accelerator 13 as they oscillate in the device. This drawback limits the duty cycle of the spectrometer to less than 0.5% at a mass resolving power of 100,000.

WO 2005/001878 proposes providing a set of periodic lenses within the field-free region so as to overcome the above described problem by preventing the ion beam from diverging in the Z-direction, thus allowing the ion flight path to be extended and the spectrometer resolution to be improved.

WO 2007/044696 further proposes orienting the orthogonal accelerator substantially orthogonal to the ion path plane of the analyzer so as to diminish aberrations of the periodic lenses while improving the duty cycle of the orthogonal accelerator. This technique capitalizes on the smaller spatial Y aberrations of ion mirrors verses the Z-aberrations of the periodic lenses. However, the duty cycle of the orthogonal accelerator is still limited to approximately 0.5% at an analyzer resolution of 100,000.

WO 2011/107836 introduced an alternative approach in order to further improve the duty cycle of the MR-TOF-MS. This approach uses a so-called open trap analyzer, wherein the number of reflections is not fixed, the spectra are composed of signal multiplets corresponding to a range of ion reflections, and the time-of-flight spectra are recovered by decoding of multiplet signals. This configuration allows elongation of both the orthogonal accelerator and the detector, thus enhancing the duty cycle.

Yet further improvement of the orthogonal acceleration duty cycle can be achieved by using frequency encoded pulsing, followed by a step of spectral decoding, as described in WO 2011/107836 and WO 2011/135477. Both of these techniques are particularly suitable for tandem mass spectrometry in combination with a high resolution MR-TOF-MS instrument (e.g., R~100,000), since the spectral decoding step relies heavily on sparse mass spectral population. However, both of these techniques restrict the dynamic range of MS-only analysers, since spectral population becomes problematic with chemical background noise, occurring at a level of 1E-3 to 1E-4 in major signals.

GB 2476964 and WO 2011/086430 propose curving of ion mirrors in the drift Z-direction, thus forming a hollow cylindrical electrostatic ion trap or MR-TOF analyzer, which allows further extension of the ion flight path for higher mass resolving power and also allows extending the ion packet size in the Z-direction for improving the orthogonal accelerator duty cycle. At much longer flight paths in the cylindrical MR-TOF the mass resolving power is no longer limited by the initial time spread of ion packets, but is rather limited by the aberrations of the analyzer. The aberrations of the flight time (TOF) are primarily due to: (i) ion energy K spread in the flight direction X; (ii) spatial spread of ion packets in the Y-direction; and (iii) spatial spread of ion packets in the drift Z-direction, causing spherical aberration of periodic lenses.

WO 2013/063587 improves the ion mirror isochronicity with respect to energy K and Y-spreads, although the aberration of periodic lenses is the major remaining TOF aberration of the analyzer. In order to reduce those lens aberrations, US 2011/186729 discloses a so-called quasi-planar ion mirror, i.e. a spatially modulated ion mirror field. However, efficient elimination of TOF aberrations in such mirrors can be only be achieved if the period of the electrostatic field modulation in the Z-direction is comparable or larger than the Y-height of the mirror window. This strongly limits the density of ion trajectory folding and flight path extension at practical analyzer sizes. Furthermore, periodic modulation in the Z-direction also affects Y-components of the field, which complicates the analyzer tuning. Thus, the cylindrical analyzer of WO 2011/08643, improved mirrors of WO 2013/063587 and quasi-planar analyzer of US 2011/186729 allow some extension of the orthogonal accelerator length so as to provide a higher duty cycle, but the resource is very limited.

Thus, prior art MR-TOF-MS instruments struggle to provide both high sensitivity and high resolution instruments.

It is desired to provide an improved spectrometer and an improved method of spectrometry.

SUMMARY

The present invention provides a multi-reflecting time-of-flight mass spectrometer (MR TOF MS) comprising:

two ion mirrors that are spaced apart from each other in a first dimension (X-dimension) and that are each elongated in a second dimension (Z-dimension) that is orthogonal to the first dimension;

an ion introduction mechanism for introducing packets of ions into the space between the mirrors such that they travel along a trajectory that is arranged at an angle to the first and second dimensions such that the ions repeatedly oscillate in the first dimension (X-dimension) between the mirrors as they drift through said space in the second dimension (Z-dimension);

wherein the mirrors and ion introduction mechanism are arranged and configured such that the ions also oscillate in a third dimension (Y-dimension), that is orthogonal to both the first and second dimensions, as the ions drift through said space in the second dimension (Z-dimension);

wherein the spectrometer comprises an ion receiving mechanism arranged for receiving ions after the ions have oscillated multiple times in the first dimension (X-dimension); and wherein at least part of the ion introduction mechanism and/or at least part of the ion receiving mechanism is arranged between the mirrors.

As the present invention causes the ions to oscillate in the third dimension (Y-dimension), the ions are able to bypass the ion introduction mechanism and/or ion receiving mechanism when they are being reflected between the ion mirrors in the first dimension (X-dimension). As such, the distance that the ions travel in the second dimension (Z-dimension) during each reflection by one of the ion mirrors can be made smaller than the length of said at least part of the ion introduction mechanism and/or the length of said at least part of the ion receiving mechanism (the length being determined in the second dimension) without the ions impacting upon the ion introduction mechanism and/or ion receiving mechanism. As such, the ions are able to perform a relatively large number of oscillations in the first dimension (X-dimension) for an analyser having a given length in the second dimension (Z-dimension), thus providing a relatively long ion Time of Flight path length and a high resolution of the analyser.

Also, the ion introduction mechanism is able to have a length in the second dimension (Z-dimension) that is relatively long, without the ions impacting on the ion introduction mechanism as the ions are reflected back and forth in the first dimension (X-dimension) between the ion mirrors. This enables the device to have an improved duty cycle and reduced space-charge effects.

The use of a relatively long ion introduction mechanism enables the introduction of ion packets having a relatively long length in the second dimension (Z-dimension). The spreading or divergence of the ion packets in the second dimension (Z-dimension) is therefore relatively small as compared to the length of the ion packets. As such, the spectrometer may not include ion optical lenses in the ion flight path from the ion introduction mechanism to the ion receiving mechanism (e.g., lenses that focus the ions in the second dimension). This avoids aberrations that would be introduced by such lenses.

The present invention also enables the ion receiving mechanism to have a length in the second dimension (Z-dimension) that is relatively long, without the ions impacting on the ion receiving mechanism as the ions are reflected back and forth in the first dimension (X-dimension) between the ion mirrors. This may be useful, for example, if the ion receiving mechanism is a detector since it enables the life time and dynamic range of the detector to be increased.

Ion mirrors are well known devices in the art of mass spectrometry and so will not be described in detail herein. However, it will be understood that according to the embodiments described herein, voltages are applied to the electrodes of the ion mirror so as to generate an electric field for reflecting ions. Ions may enter the ion mirror along a trajectory that is substantially parallel to the direction of the electric field, are retarded and turned around by the electric field, and are then accelerated by the electric field out of the ion mirror in a direction substantially parallel to the electric field.

GB 2396742 (Bruker) and JP 2007227042 (Joel) each discloses an instrument comprising two opposing electric sectors that are separated by a flight region. Ions are guided through the instrument in a figure-of-eight pattern by the opposing electric sectors. However, these instruments do not have two ion mirrors for performing the reflections and so are less versatile than the ion mirror based system of the present invention. The skilled person will appreciate that electric sectors are not ion mirrors. The skilled person would not be motivated, based on the teachings of Bruker or Joel, to overcome the above described problems with mirror based MR-TOF-MS instruments in the manner claimed in the present application, since Bruker and Joel do not relate to mirrored MR-TOF-MS instruments.

According to the embodiments of the present invention, the ion introduction mechanism comprises a controller, at least one voltage supply (i.e. at least one DC and/or RF voltage supply), electronic circuitry and electrodes. The controller may comprise a processor that is arranged and configured to control the voltage supply to apply voltages to the electrodes, via the circuitry, so as to pulse ions into one of the ion mirrors along said trajectory that is at an angle to the first and second dimensions. The processor may also be arranged and configured to control the voltage supply to apply voltages to the electrodes, via the circuitry, so as to pulse ions into one of the ion mirrors and at an angle or position relative to the mirror axes such that the ions oscillate in a third dimension (Y-dimension). Alternatively, or additionally, the spectrometer also comprises a controller, at least one voltage supply (i.e. at least one DC and/or RF voltage supply), electronic circuitry and electrodes for controlling the voltages applied to the mirror electrodes, via the circuitry, so as to cause ions oscillate in a third dimension (Y-dimension).

The ions may oscillate in the third dimension (Y-dimension) about an axis and between positions of maximum amplitude, and said at least part of the ion introduction mechanism and/or said at least part of the ion receiving mechanism may be arranged so as to extend over only part of the space that is between the positions of maximum amplitude. This allows the ions to travel through the space at which the ion introduction mechanism and/or ion receiving mechanism is not located, thereby bypassing one of both of these elements during at least some of the oscillations in the first dimension (X-dimension.

When the positions and dimensions of said at least part of the ion introduction mechanism are referred to herein, these may refer to the positions and dimensions of the part of the ion introduction mechanism that is arranged between the positions of maximum amplitude. Similarly, when the positions and dimensions of said at least part of the ion receiving mechanism are referred to herein, these may refer to the positions and dimensions of the part of the ion receiving mechanism that is arranged between the positions of maximum amplitude.

The ion mirrors and ion introduction mechanism may be configured so as to cause the ions to travel a distance $Z_R$ in the second dimension (Z-dimension) during each reflection of the ions between the mirrors in the first dimension (X-dimension); wherein the distance $Z_R$ is smaller than the length in the second dimension (Z-dimension) of said at least part of the ion introduction mechanism and/or of the length in the second dimension (Z-dimension) of said at least part of the ion receiving mechanism. The length in the second dimension (Z-dimension) of said at least part of the ion introduction mechanism may be the length of the part of the ion introduction mechanism that is arranged between the mirrors, or the length of the part of the ion introduction mechanism that is arranged between said positions of maximum amplitude. Similarly, the length in the second dimension (Z-dimension) of said at least part of the ion receiving mechanism may be the length of the part of the ion receiving mechanism that is arranged between the mirrors, or the length of the part of the ion receiving mechanism that is arranged between said positions of maximum amplitude.

Optionally, the length in the second dimension (Z-dimension) of said at least part of the ion introduction mechanism and/or of the length in the second dimension (Z-dimension) of said at least part of the ion receiving mechanism is up to four times the distance $Z_R$.

The ion mirrors and ion introduction mechanism may be configured so as to cause the ions to oscillate at rates in the first dimension (X-dimension) and third dimension (Y-dimension) such that when the ions have the same position in the first and second dimensions (X and Z dimensions) as said at least part of the ion introduction mechanism, the ions have a different position in the third dimension (Y-dimension), such that the trajectories of the ions bypass said ion introduction mechanism at least once as the ions oscillate in the first dimension (X-dimension).

Alternatively, or additionally, the ion mirrors and ion introduction mechanism may be configured so as to cause the ions to oscillate at rates in the first dimension (X-dimension) and third dimension (Y-dimension) such that when the ions have the same position in the first and second dimensions (X and Z directions) as said at least part of the ion receiving mechanism, the ions have a different position in the third dimension (Y-dimension), such that the trajectories of the ions bypass said ion receiving mechanism least once as they oscillate in the first dimension (X-dimension).

The mirrors and ion introduction mechanism may be configured such that the ions oscillate in the third dimension (Y-dimension) with an amplitude selected from the group consisting of: ≥0.5 mm; ≥1 mm; ≥1.5 mm; ≥2 mm; ≥2.5 mm; ≥3 mm; ≥3.5 mm; ≥4 mm; ≥4.5 mm; ≥5 mm; ≥6 mm; ≥7 mm; ≥8 mm; ≥9 mm; ≤10 mm; ≤9 mm; ≤8 mm; ≤7 mm; ≤6 mm; ≤5 mm; ≤4.5 mm; ≤4 mm; ≤3.5 mm; ≤3 mm; ≤2.5 mm; and ≤2 mm. The ions may oscillate in the third dimension (Y-dimension) with an amplitude in a range that is defined by any one of the combinations of ranges described above.

The inventors have recognised that analyzer aberrations may grow rapidly with the amplitude of ion displacement in the third dimension (Y-dimension). It may therefore be desirable to maintain a moderate displacement of the ion packets in the third dimension (Y-dimension).

In order to achieve a moderate displacement in the third dimension (Y-dimension), the ion introduction mechanism or ion receiving mechanism may be relatively narrow in the third dimension (Y-dimension). For example, these components may be formed using resistive boards. The ion introduction mechanism or ion receiving mechanism may have a width in the third dimension (Y-dimension) selected from the group consisting of: ≤10 mm; ≤9 mm; ≤8 mm; ≤7 mm; ≤6 mm; ≤5 mm; ≤4.5 mm; ≤4 mm; ≤3.5 mm; ≤3 mm; ≤2.5 mm; and ≤2 mm.

The ions oscillate in the third dimension (Y-dimension) about an axis with a maximum amplitude of oscillation, and said at least part of the ion introduction mechanism, and/or said at least part of the ion receiving mechanism, may be spaced apart from the axis in the third dimension (Y-dimension) by a distance that is smaller than the maximum amplitude of oscillation.

Optionally, the mirrors and ion introduction mechanism may be configured such that the ions oscillate in the first dimension (X-dimension) with an amplitude selected from the group consisting of: ≥0.5 mm; ≥1 mm; ≥1.5 mm; ≥2 mm; ≥2.5 mm; ≥3 mm; ≥3.5 mm; ≥4 mm; ≥4.5 mm; ≥5 mm; 7.5 mm; 10 mm; 15 mm; 20 mm; ≤20 mm; ≤15 mm; ≤10 mm; ≤9 mm; ≤8 mm; ≤7 mm; ≤6 mm; ≤5 mm; ≤4.5 mm; ≤4 mm; ≤3.5 mm; ≤3 mm; ≤2.5 mm; and ≤2 mm.

The ions oscillate in the first dimension (X-dimension) about an axis with a maximum amplitude of oscillation, and said at least part of the ion introduction mechanism, and/or said at least part of the ion receiving mechanism, may be spaced apart from the axis in the first dimension (X-dimension) by a distance that is smaller than the maximum amplitude of oscillation.

The ion mirrors and ion introduction mechanism may be configured such that in use the ions oscillate periodically in the first dimension (X-dimension) and/or third dimension (Y-dimension) as they drift through said space between the ion mirrors in the second dimension (Z-dimension).

The ion mirrors may be arranged and configured such that the ion packets oscillate in the third dimension (Y-dimension) with a period corresponding to the time it takes for the ions to perform four oscillations between the ion mirrors in the first dimension (X-dimension).

The ions may oscillate in the first dimension (X-dimension) and the third dimension (Y-dimension) so as to have a combined periodic oscillation in a plane defined by the first and third dimensions. The period of the combined oscillation may correspond to the time taken for two or four ion mirror reflections in the first dimension (X-dimension).

The total number of ion mirror reflections in the first dimension (X-dimension) and/or the third dimension (Y-dimension) between the ions leaving the ion introduction mechanism and the ions being received at the ion receiving mechanism may be a multiple of two or a multiple of four. For example, the total number of reflections may be: ≥2; ≥4; ≥6; ≥8; ≥10; ≥12; ≥14; or ≥16.

The coordinate and angular linear energy dispersion in the third dimension (Y-dimension) may be eliminated after: (i) every two ion mirror reflections; (ii) after every four ion mirror reflections; or (iii) by the time that the ions are received at the ion receiving mechanism.

The spatial phase space may experience unity linear transformation in the plane defined by the first dimension (X-dimension) and the third dimension (Y-dimension) after: (i) every two ion mirror reflections; (ii) after every four ion mirror reflections; or (iii) by the time that the ions are received at the ion receiving mechanism.

The ions oscillate in the third dimension (Y-dimension) about an axis of oscillation, and the spectrometer may be arranged and configured such that either: (i) said at least part of the ion introduction mechanism and said at least part of ion receiving mechanism are spaced apart from the axis in the third dimension (Y-dimension); or (ii) either one of said at least part of the ion introduction mechanism and said at least part of ion receiving mechanism is located on the axis, and the other of said at least part of the ion introduction mechanism and said at least part of ion receiving mechanism is spaced apart from the axis in the third dimension (Y-dimension); or (iii) both said at least part of the ion introduction mechanism and said at least part of the ion receiving mechanism are located on the axis.

Said at least part of the ion introduction mechanism and said at least part of the ion receiving mechanism may be spaced apart from the axis such that they are located on the same side of the axis in the third dimension (Y-dimension); or such that they are located on the different sides of the axis in the third dimension (Y-dimension).

Said at least part of the ion introduction mechanism and said at least part of the ion receiving mechanism may be spaced apart at opposite ends of the device in the second dimension (Z-dimension). Alternatively, said at least part of ion introduction mechanism and said at least part of the ion receiving mechanism may be located at a first end of the device, and the ions may initially drift towards the second, opposite end of the device (in the second dimension) before being reflected to drift back towards the first end of the device so as to reach said at least part of the ion receiving mechanism.

The at least part of the ion introduction mechanism has an ion exit plane through which the ions exit or are emitted from the mechanism, and said at least part of the ion receiving mechanism has an ion input plane through which the ions enter or strike the mechanism. The ions oscillate in the first dimension (X-dimension) about an axis of oscillation, and optionally: (i) both the ion exit plane and the ion input plane are located on the axis; or (ii) the ion exit plane and the ion input plane are spaced apart from the axis in the first dimension (X-dimension); or (iii) either one of ion exit plane and the ion input plane is located on the axis, and the other of the ion exit plane and the ion input plane is spaced apart from the axis in the first dimension (X-dimension).

Said at least part of the ion receiving mechanism may be arranged between the mirrors for receiving ions from the space between the mirrors after the ions have oscillated one or more times in the third dimension (Y-dimension).

Said at least part of the ion receiving mechanism may be an ion detector. The ion detector may be arranged between the ion mirrors.

Said ion detector may comprise an ion-to-electron converter, an electron accelerator and a magnet or electrode for steering the electrons to an electron detector. This configuration enables the ion detector to have a small size rim in the third dimension (Y-dimension), e.g., relative to amplitude of oscillation of the ions in the third dimension (Y-dimension). This enables the ion detector (including the magnet) to be displaced in the third dimension (Y-dimension) so as to avoid interference with said ion trajectory until it is desired for the ions to impact on the detector. The secondary electrons generated by impact of the ions on the detector may be focused onto a detector (for smaller spot in fast detectors) or defocused onto a detector (for longer detector life time) by either non-uniform magnetic or electrostatic fields.

Alternatively, the ion receiving mechanism may comprise an ion guide and said at least part of the ion receiving mechanism may be the entrance to the ion guide.

The spectrometer may further comprise an ion detector arranged outside of the space between the ion mirrors, and the ion guide may be arranged and configured to receive ions from said space between the ion mirrors and to guide the ions onto the ion detector.

The ion guide may be an electric or magnetic sector.

The sector may be arranged and configured for isochronous ion transfer from the space between the ion mirrors to the detector or ion analyser.

The ion guide may have a longitudinal axis along which the ions travel, wherein the longitudinal axis is curved.

As described above, said at least part of the ion receiving mechanism (e.g., entrance to the ion guide) may be displaced in the third dimension (Y-dimension) from the axis about which ions oscillate in the third dimension (Y-dimension), or may be located on the axis. When the location of said at least part of the ion receiving mechanism is being described, it is preferably the central axis of the entrance that is being referred to.

Alternatively, the ion receiving mechanism may be an ion deflector for deflecting ions out of the space between the mirrors, optionally, onto a detector arranged outside of the space between the ion mirrors.

The ion introduction mechanism may be a pulsed ion source arranged between the mirrors and configured to eject, or generate and emit, packets of ions so as to perform the step of introducing ions into the space between the mirrors.

The pulsed ion source may comprise an orthogonal accelerator or ion trap pulsed converter for converting a beam of ions into packets of ions.

The orthogonal accelerator or ion trap may be configured to convert a continuous ion beam into pulsed ion packets.

The ion trap may be a linear ion trap, which may be elongated in the second dimension (Z-dimension).

The orthogonal accelerator or ion trap may comprise a gridless accelerator terminated by an electrostatic lens for providing minimal ion packet divergence of few mrad in the third dimension (Y-dimension).

The ion source may comprise one or more pulsed or continuous ion steering device for steering the ions so as to pass along said trajectory that is arranged at an angle to the first and second dimensions. The one or more steering device may deflect the ions by a steering angle in a plane defined by the first and third dimensions (X-Y plane) and/or in a plane defined by the first and second dimensions.

The orthogonal accelerator or ion trap may be configured to receive a beam of ions along an axis that is titled with respect to the second dimension (Z-dimension), and wherein the tilt angle and the steering angle are arranged for mutual compensation of at least some time-of-flight aberrations of the spectrometer.

Alternatively, the ion introduction mechanism may comprise an ion guide and said at least part of the ion introduction mechanism may be the exit of the ion guide.

The spectrometer may further comprise an ion source arranged outside of the space between the ion mirrors, and the ion guide may be arranged and configured to receive ions from said ion source and to guide the ions into said space so as to pass along said trajectory that is arranged at an angle to the first and second dimensions.

The ion guide may be an electric or magnetic sector.

The sector may be arranged and configured for isochronous ion transfer from the ion source to the space between the ion mirrors.

The ion guide may have a longitudinal axis along which the ions travel, wherein the longitudinal axis is curved.

As described above, said at least part of the ion introduction mechanism (e.g., exit of the ion guide) may be displaced in the third dimension (Y-dimension) from the axis about which ions oscillate in the third dimension (Y-dimension), or may be located on the axis. When the location of said at least part of the ion introduction mechanism is being described, it is preferably the central axis of the exit that is being referred to.

Alternatively, said at least part of the ion introduction mechanism may be an ion deflector for deflecting the trajectory of the ions.

The ion mirrors may be parallel to each other.

The ion mirrors may be electrostatic mirrors.

The ion mirrors may be gridless ion mirrors.

The ions oscillate in the third dimension (Y-dimension) about an axis of oscillation, and the ion mirrors may be symmetric relative to a plane in the first and second dimensions (X-Z plane) that extends through the axis; and/or the ion mirrors may be symmetric relative to a plane in the second and third dimensions (Y-Z plane) that extends through the axis.

The ion mirrors may be planar.

The ion mirrors may be configured such that the average ion trajectory in the Z-dimension is straight, or is less preferably curved.

The ion mirrors described herein may comprise flat cap electrodes that may be maintained at separate electric potentials for reaching at least fourth order time per energy focusing.

The maximum amplitude with which ions oscillate in the third dimension (Y-dimension) may be between ⅛ and ¼ of the height H in the third dimension (Y-dimension) of the window in the ion mirror.

The ion mirror electric fields may be tuned so as to provide for achromatic unity transformation of the spatial phase space of the ion packet after each four reflections, providing point-to-point and parallel-to-parallel ion beam transformation with unity magnification (as shown in FIG. 5).

The total ion flight path may include at least 16 reflections from the ion mirrors.

According to the general ion-optical theory, the described properties provide reduced time aberrations with respect to the spatial spread and thus improve isochronicity for ions that oscillate in the third dimension (Y-dimension).

The spectrometer may further comprise one or more beam stops arranged between the ion mirrors and in the ion flight path between the ion introduction mechanism and the ion receiving mechanism. The one or more beam stops may be arranged and configured so as to block the passage of ions that are located at the front and/or rear edge of each ion beam packet as determined in the second dimension (Z-dimension). Alternatively, or additionally, each packet of ions may diverge in the second dimension (Z-dimension) as it travels from the ion introduction mechanism to the ion receiving mechanism; and the one or more beam stops may be arranged and configured to block the passage of ions in the ion packet that diverge from the average ion trajectory by more than a predetermined amount.

At least one of the beam stops may be an auxiliary ion detector.

The spectrometer may comprise: a primary ion detector arranged and configured for detecting the ions after they have performed a desired number of oscillations in the first dimension (X-dimension) between the mirrors; said auxiliary ion detector, wherein said auxiliary detector is arranged and configured to detect a portion of the ions in each ion packet and to determine the intensity of ions in each ion packet; and a control system for controlling the gain of the primary ion detector based on the intensity detected by the auxiliary detector.

The spectrometer may comprise: a primary ion detector arranged and configured for detecting the ions after they have performed a desired number of oscillations in the first dimension (X-dimension) between the mirrors; said auxiliary ion detector, wherein said auxiliary detector is arranged and configured for detecting a portion of the ions in each ion packet; and a control system for steering the trajectories of the ion packets based on the signal output from the auxiliary ion detector, optionally for optimising ion transmission from the ion introduction mechanism to the primary ion detector.

One or more ion lens for focusing ion in the second dimension (Z-dimension) may or may not be provided between the mirrors. It may be desired to avoid the use of such lenses so as to avoid large spherical aberrations for ion packets elongated in the second dimension (Z-dimension). The initial length of the ion packet in the second dimension (Z-dimension) may be chosen to be longer than the natural spreading of the ion packets in the second dimension (Z-dimension) during passage through the analyser. Instead, beam stops may be used, as described below, to prevent spectral overlaps. However, it is contemplated that periodic lenses may be uses if combined with quasi-planar spatially modulated ion mirrors, e.g., as described in US 2011/186729.

The present invention also provides a method of time-of-flight mass spectrometry comprising:

providing two ion mirrors that are spaced apart from each other in a first dimension (X-dimension) and that are each elongated in a second dimension (Z-dimension) that is orthogonal to the first dimension;

introducing packets of ions into the space between the mirrors using an ion introduction mechanism such that the ions travel along a trajectory that is arranged at an angle to the first and second dimensions such that the ions repeatedly oscillate in the first dimension (X-dimension) between the mirrors as they drift through said space in the second dimension (Z-dimension);

oscillating the ions in a third dimension (Y-dimension), that is orthogonal to both the first and second dimensions, as the ions drift through said space in the second dimension (Z-dimension); and receiving the ions in or on an ion receiving mechanism after the ions have oscillated multiple times in the first dimension (X-dimension);

wherein at least part of the ion introduction mechanism and/or at least part of the ion receiving mechanism is arranged between the mirrors.

The spectrometer used in this method may have any of the optional features described herein.

In order to obtain high MR-TOF resolution whilst having a reasonable length of the MRTOF analyzer in the second dimension (Z-dimension), it is desired to inject the ions at angle to the first dimension (X-dimension) of being about 10-20 mrad.

The ion trajectories may be allowed to overlap in the plane defined by the first dimension (X-dimension) and the second dimension (Z-dimension) after one or more reflections by the ions mirror(s). This allows a reduction in the angle that the ions are injected, thus decreasing the overall length of the device in the second dimension (Z-dimension).

The spectrometer described herein may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The spectrometer may comprise an electrostatic ion trap or mass analyser that employs inductive detection and time domain signal processing that converts time domain signals to mass to charge ratio domain signals or spectra. Said signal processing may include, but is not limited to, Fourier Transform, probabilistic analysis, filter diagonalisation, forward fitting or least squares fitting.

The spectrometer may comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage may have an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage may have a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The spectrometer may also comprise a chromatography or other separation device upstream of an ion source. The chromatography separation device may comprise a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

BRIEF DESCRIPTION OF THE DRAWINGS

Various embodiments of the present invention will now be described, by way of example only, and with reference to the accompanying drawings in which.

DETAILED DESCRIPTION

Figure 1:
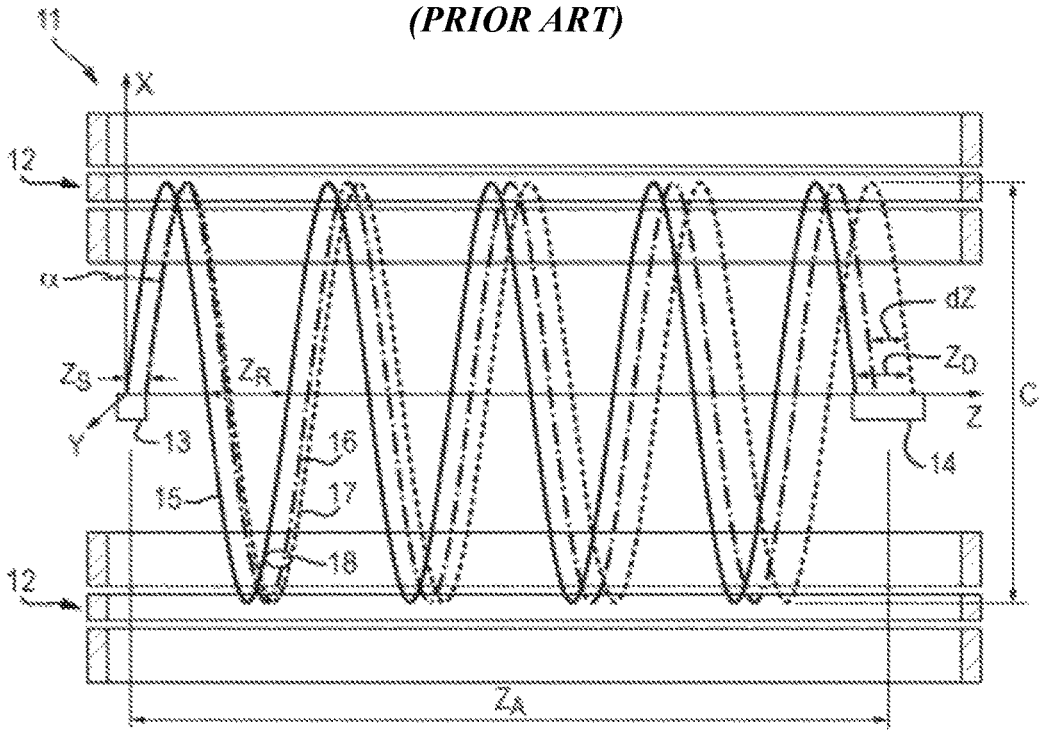
Fig. 1 (PRIOR ART)
FIG. 1 shows an MR-TOF-MS instrument according to the prior art.

In order to assist the understanding of the present invention, a prior art instrument will now be described with reference to FIG. 1. FIG. 1 shows a schematic of the 'folded path' planar MR-TOF-MS of SU 1725289, incorporated herein by reference. The planar MR-TOF-MS 11 comprises two gridless electrostatic mirrors 12, each composed of three electrodes that are extended in the drift Z-direction. Each ion mirror forms a two-dimensional electrostatic field in the X-Y plane. An ion source 13 (e.g., pulsed ion converter) and an ion receiver 14 (e.g., detector) are located in the drift space between said ion mirrors 12 and are spaced apart in the Z-direction. Ion packets are produced by the source 13 and are injected into the time of flight region between the mirrors 12 at a small inclination angle $\alpha$ to the X-axis. The ions therefore have a velocity in the X-direction and also have a drift velocity in the Z-direction. The ions are reflected between the ion mirrors 12 multiple times as they travel in the Z-direction from the source 13 to the detector 14. The ions thus have jigsaw ion trajectories 15,16,17 through the device.

The ions advance in the drift Z-direction by an average distance $Z_R \sim C^* \sin \alpha$ per mirror reflection, where C is the distance in the X-direction between the ion reflection points. The ion trajectories 15 and 16 represent the spread of ion trajectories caused by the initial ion packet width $Z_S$ in the ion source 13. The trajectories 16 and 17 represent the angular divergence of the ion packet as it travels through the instrument, which increases the ion packet width in the Z-direction by an amount dZ by the time that the ions reach the detector 14. The overall spread of the ion packet by the time that it reaches the detector 14 is represented by $Z_D$.

The MR-TOF-MS 11 provides no ion focusing in the drift Z-direction, thus limiting the number of reflection cycles between the ion mirrors 12 that can be performed before the ion beam becomes overly dispersed in the Z-direction by the time it reaches the detector 14. This arrangement therefore requires a certain ion trajectory advance per reflection $Z_R$ which must be above a certain value in order to avoid ion trajectories overlapping due to ion dispersion and causing spectral confusion.

As has been described in WO 2014/074822, incorporated herein by reference, the lowest realistic divergence of ion packets is expected to be about +/−1 mrad for known orthogonal ion accelerators, radial traps and pulsed ion sources. The combination of initial velocity and spatial spread of the ions in a realistic ion source limits the minimal turnaround time of the ions at maximal energy spread. In order for the MR-TOF-MS instrument to reach mass resolving powers above R=200000, the ion flight path through the time of flight region of the instrument must be extended to at least 16 m. Accordingly, the beam width in the Z-direction at the detector 14 is expected to be $Z_D \sim 30$ mm. Further, in order to avoid ion trajectory and signal overlapping between adjacent mirror reflections in the prior art instrument 11, the ion trajectory advance per mirror reflection $Z_R$ must be at least 50 mm, so as to exceed the ion packet spreading at the detector $Z_D$. Accordingly, the total advance in the Z-direction for 16 reflections (i.e. the distance between source 13 and detector 14) is $Z_A$>800 mm. When accounting for Z-edge fringing fields, electrode widths, gaps for electrical isolation and vacuum chamber width, the estimated analyzer size in the X-Z plane would be above 1 m×1 m. This is beyond the practical size for a commercial instrument, for example, because the vacuum chamber would be too large and unstable.

Another problem of such planar MR-TOF analyzers 11 is the small duty cycle due to the orthogonal accelerator 13. For example, in order to avoid spectral overlaps for values of ion trajectory advance per mirror reflection $Z_R$=50 mm and beam width at detector $Z_D$=40 mm, the width of each injected ion packets is limited to about $Z_S$=10 mm. The duty cycle of an orthogonal accelerator can be estimated as a ratio $Z_S/Z_A$, and is therefore about 1% for the example in which $Z_A$>800 mm. When using smaller analyzers, the duty cycle therefore rapidly diminishes and drops even lower than this.

Embodiments of the present invention provide a planar MR-TOF-MS instrument having an improved duty cycle, high resolution and practical size. For example, the instrument may have an improved duty cycle while reaching a resolution above 200,000 and having a size below 0.5 m×1 m.

The inventors have realized that the planar MR-TOF-MS instrument may be substantially improved by oscillating the ions in the X-Y plane such that ions do not collide with the source 13 (e.g., orthogonal accelerator) when they are reflected between the ion mirrors 12. Alternatively, or additionally, the ions may be oscillated in the X-Y plane such that ions do not collide with the receiver 14 (e.g., detector) until the ions have performed at least a predetermined number of ion mirror reflections. The embodiments therefore relate to an instrument that is similar to that shown and described in relation to FIG. 1, except that the ions are oscillated in the X-Y plane.

Figure 2:
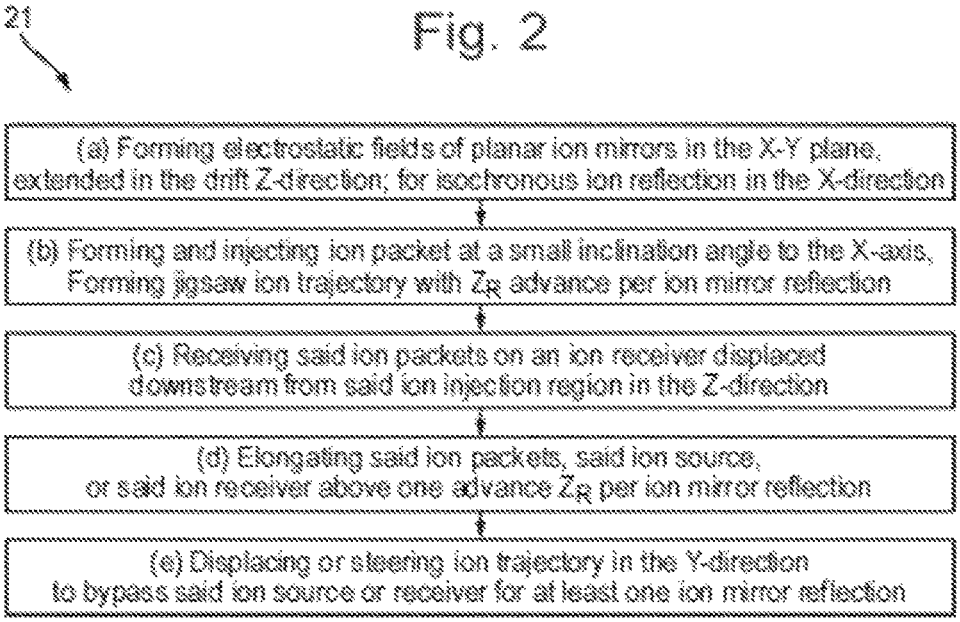
FIG. 2 shows a block diagram of the method of multi-reflecting time-of-flight mass spectrometric analysis according to an embodiment of the present invention.

FIG. 2 shows a flow diagram illustrating a method 21 of multi-reflecting time-of-flight mass spectrometric analysis according to an embodiment of the present invention. The method comprises the following steps: (a) forming ion mirrors having two substantially parallel aligned electrostatic fields, wherein said fields may be two-dimensional in the X-Y plane and substantially extended along the drift Z-direction, and wherein said fields may be arranged for isochronous ion reflection in the X-direction; (b) forming pulsed ion packets in an ion source and injecting each ion packet at a relatively small inclination angle to the X-axis in the X-Z plane, thus forming a mean jigsaw ion trajectory with an advance distance $Z_R$ per ion mirror reflection; (c) receiving said ion packets on an ion receiver displaced downstream in the Z-direction from said ion injection region; (d) providing said ion packets, said ion source, or said ion receiver so as to be elongated with a width above one advance $Z_R$ per ion mirror reflection; and (e) displacing or steering at least a portion of said mean ion trajectory in the Y-direction so as to form periodic ion trajectory oscillations in the X-Y plane so as to bypass said ion source or said ion receiver for at least one ion mirror reflection.

An important feature of the embodiments of the present invention is to cause the ions to bypass the ion source 13 and/or ion detector 14 by causing the ions to periodically oscillate within the analyzer in the X-Y plane together with ion drift in the X-Z plane under a relatively small ion injection angle α. This will be described in more detail below.

Figure 3A:
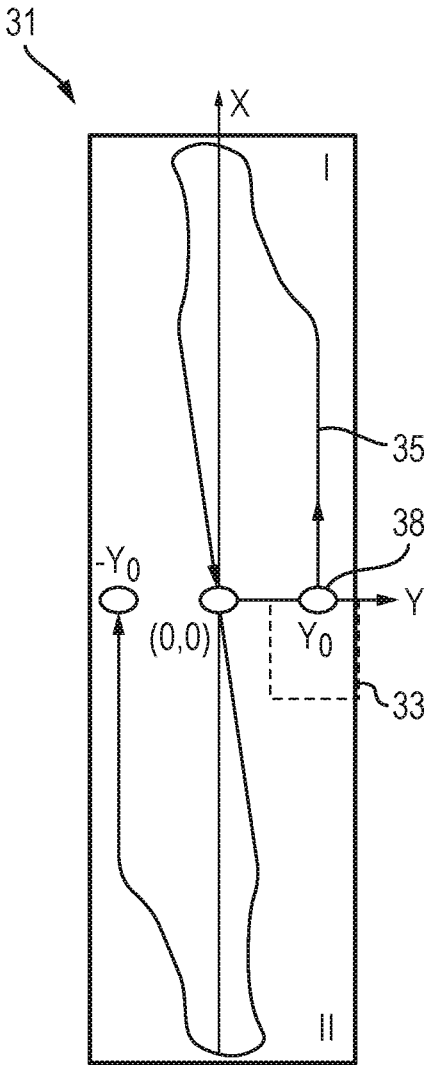
FIGS. 3A-3B show simulated and schematic views of the ion trajectory in the X-Y plane of an MRTOF analyzer according to an embodiment of the present invention.
Figure 3B:
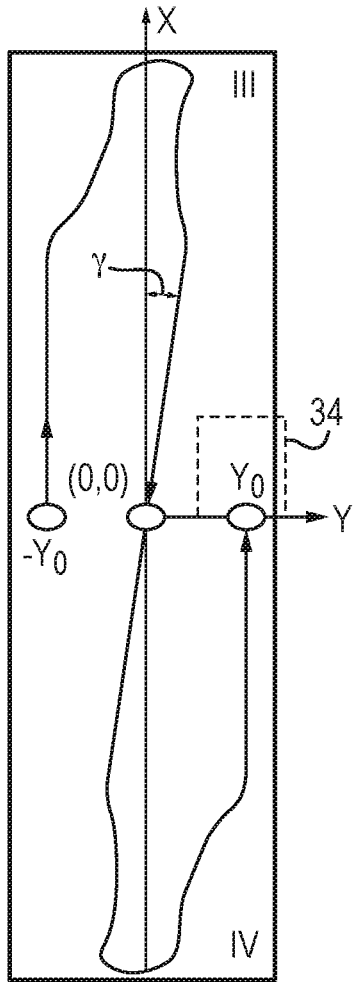

FIGS. 3A and 3B illustrate the ion trajectories in the X-Y plane 31 of the analyser for four reflections between the ion mirrors. In these embodiments the ion source 33 and the ion detector 34 are displaced from the central axis of the device in the +Y direction by a distance $Y_0$. FIG. 3A illustrates the ion trajectory during a first of the ion reflections (I), in which the ions are pulsed from the ion source 33 into the upper ion mirror and are then reflected back to the central axis of the device. FIG. 3A also illustrates the ion trajectory during the second of the ion reflections (II), in which the ions continue to travel from the central axis of the device into the lower ion mirror and are then reflected back to the central Y-Z plane at a location that is displaced from the central axis in the −Y direction by a distance $Y_0$. FIG. 3B illustrates the ion trajectory during a third of the ion reflections (III), in which the ions continue to travel back into the upper ion mirror and are then reflected back to the central Y-Z plane at a location on the central axis. FIG. 3B also illustrates the ion trajectory during a fourth of the ion reflections (IV), in which the ions continue to travel from the central axis of the device into the lower ion mirror and are then reflected back to the central Y-Z plane at a location that is displaced from the central axis in the +Y direction by a distance $Y_0$, at which point the ions impact on the detector 34.

The mean ion trajectories are modeled for a distance between ion mirror reflections (or distance between mirror caps) of C=1 m and for a displacement $Y_0$=5 mm. In order to more clearly illustrate the embodiments, the ion trajectories in the Y-direction have been exaggerated. As shown in FIG. 3A, the first segment (I) of the mean ion trajectory starts at middle plane X=0, at a Y-displacement of $Y_0$=5 mm, and the ions initially travel parallel to the X-axis (i.e. angle γ=0). The ions then travel into the upper ion mirror, which causes the ions to oscillate in the Y-direction. After one mirror reflection, the ions returns to the central axis (X=0; Y=0), though at an angle of γ=7 mrad. The second segment (II) of the mean ion trajectory continues, and after the mirror reflection returns to the X=0 plane at a Y displacement of −5 mm and parallel to the X-axis (γ=0). As shown in FIG. 3B, the third segment (III) of the mean ion trajectory continues and after the mirror reflection the ions return to the central axis (X=0; Y=0) at an angle γ=−7 mrad. The fourth segment (IV) of the mean ion trajectory continues and after the mirror reflection the ions returns to the original point in the X-Y plane (i.e. Y=5 mm, γ=0), thus closing the trajectory loop after four mirror reflections. It will however, be appreciated that the ions continue to move in the Z-direction during the four oscillations.

The analyzer electrostatic field is assumed to be optimized for minimal time per spatial aberrations as described below, so that the repetitive trajectory loop stays at minor spatial diffusion of ion packets for multiple oscillations.

Again referring to FIGS. 3A and 3B, the ion trajectories oscillate in the Y-direction and do not return to their initial Y-direction displacement until every fourth ion mirror reflection. As the ion source 33 is located in the initial Y-direction position, this ensures that it is not possible for the ions to impact on the ion source 33 for the first three out of every four reflections (provided that the ion source and ion packet maintain a moderate width in the Y-direction as compared to the initial $Y_0$ displacement of the ions). This means that the ions are able to drift along the device in the Z-direction for three out of four reflections without being at a Y-location in which they could impact on the ion source 33. As such, this enables the length of the ion source to be extended in the Z-direction without interfering with the ion trajectories during the first three reflections. The length of the ion source 33 can be extended up to a length of $4Z_R$, i.e. four advances per mirror reflection, thus increasing the number of ions that may be injected between the mirrors and enhancing the duty cycle of the instrument. The elongation of ion packets in the Z-direction at the source 33 makes the instrument less sensitive to ion packet spreading in the Z-direction between the source 33 and the detector 34, since such spreading becomes smaller or more comparable to the initial Z-size of ion packet. Ion packet elongation also reduces space-charge effects in the analyzer. It also allows the use of a larger area detector 34, thus extending the dynamic range and lifetime of the detector 34.

Alternatively, rather than the Y-oscillations being used to enable an increase in the ion source length, the Y-oscillations can be used to decrease the distance $Z_R$ that the ions travel per ion mirror reflection whilst preventing the ions from colliding with the ion source 33, thereby reducing the size of the instrument in the Z-direction.

Although the technique of oscillating ions in the Y-direction has been described as being used for preventing the ions from impacting the ion source 33 during the ion reflections, the technique can alternatively, or additionally, be used for preventing ions from impacting on the detector until the desired number of ion mirror reflections (in the X-direction) have been achieved.

Note that different ion mirror fields and ion injection schemes for injecting ions between the mirrors may be employed to form different patterns of looped X-Y oscillations, e.g., an oval trajectory or a pattern with a yet larger number of mirror reflections per full ion path loop may be used. Also, Y-oscillations may be induced by ion packet angular steering.

Figure 4A:
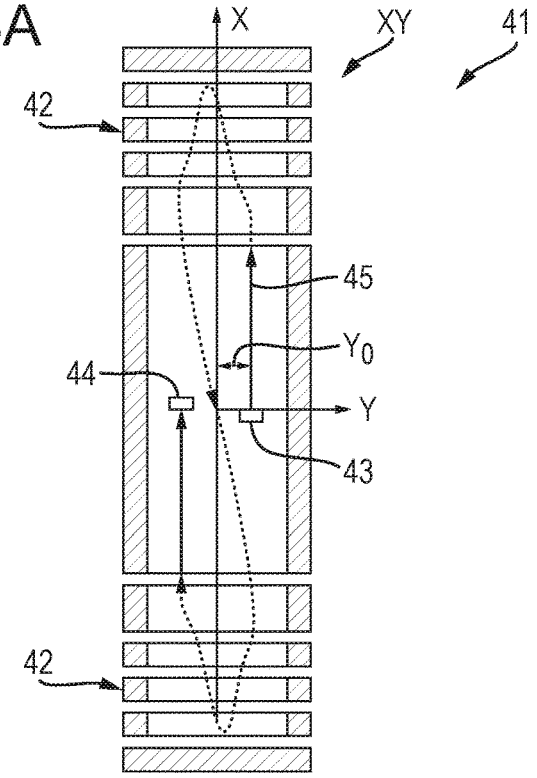
FIGS. 4A-4D show two and three-dimensional schematic views of an MR-TOF-MS according to an embodiment of the present invention, wherein the ion source and detector are displaced in the Y-direction.
Figure 4B:
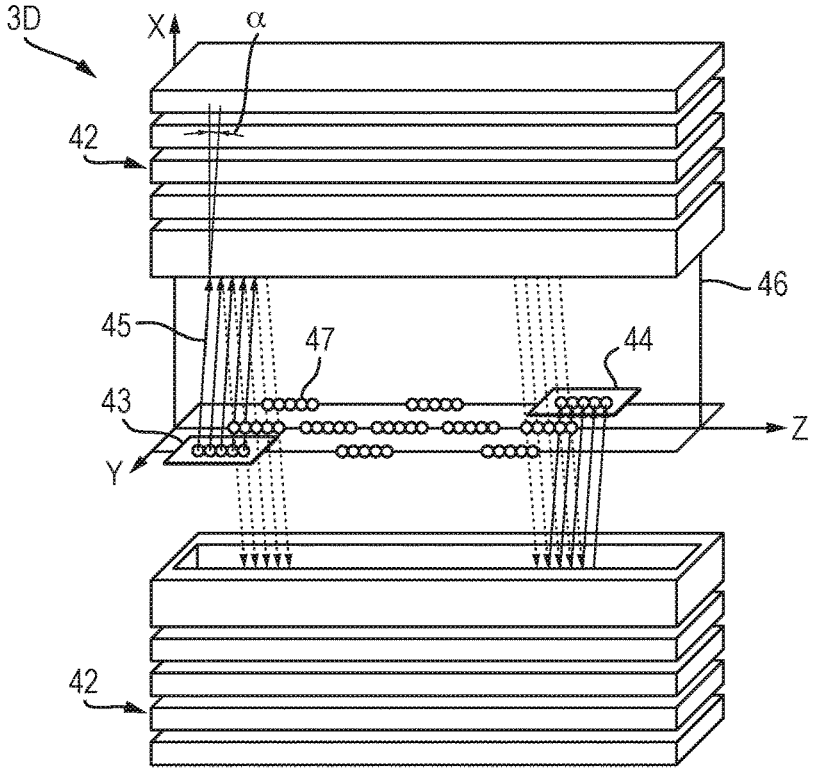
Figure 4C:
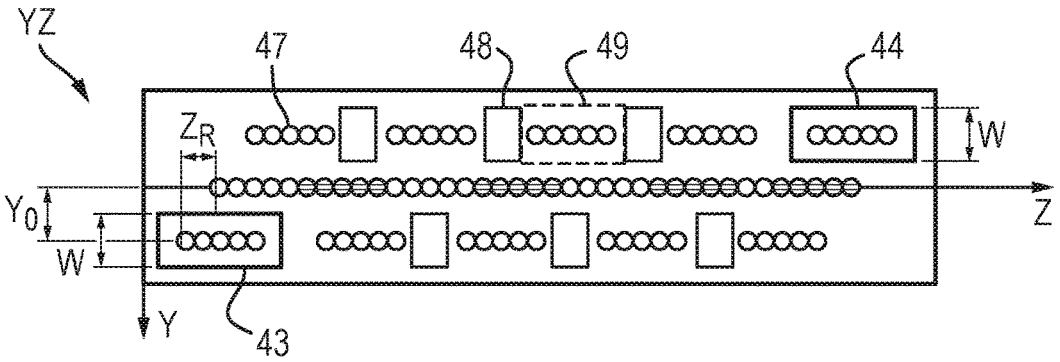

FIGS. 4A-4C show three different views of an embodiment of a MR-TOF-MS instrument according to the present invention. FIG. 4A shows a view of the embodiment in the X-Y plane, FIG. 4B shows a perspective view, and FIG. 4C shows a view in the Y-Z plane. The embodiment 41 is a planar MR-TOF instrument comprising two parallel gridless ion mirrors 42, an ion source 43 (e.g., a pulsed ion source or orthogonal ion accelerator), an ion receiver 44 (e.g., detector), optional stops 48, and an optional lens 49 for spatially focusing ions in the Z-direction. The ion mirrors 42 are substantially extended in the drift Z-direction, thus forming two dimensional electrostatic fields in the X-Y plane at sufficient distance (about twice the Y-height of the ion mirror window) from the Z-edges of ion mirror electrodes. The ion source 43 and the ion detector 44 are arranged on opposite lateral sides of the middle X-Z plane 46 through the analyser, with each of the ion source 43 and detector 44 being displaced a distance $Y_0$ from the analyzer middle X-Z plane 46. In this embodiment, both the ion source 43 and ion detector 44 are relatively narrow in the Y-direction. For clarity, it is assumed that the half width (W/2) of each of the ion source 43 and of the detector 44 is less than the $Y_0$ displacement, that the ion source 43 is symmetric in the Y-direction, and that it emits ion packets from its centre.

An important feature of the embodiments of the present invention is that the ion trajectories 45 are displaced in the Y-direction such that they bypass the ion source 43 as they travel along the Z-direction. As shown in FIG. 4A, the off-axis mean ion trajectory 45 starts at a displacement in the Y-direction of $Y_0$ and proceeds in the manner described with reference to FIGS. 3A and 3B. FIG. 4A shows the ion trajectory as dashed lines for two mirror reflections, although more than two ion mirror reflections may be performed before the ions arrive at the detector, as will be described with reference to FIGS. 4B and 4C.

All views demonstrate how ion trajectory 45 oscillates in the X-Y plane with a period corresponding to four mirror reflections. The trajectory 45 bypasses the ion source 43 for three ion mirror reflections and returns to the same positive Y-displacement after four reflections.

As shown in FIG. 4B, the ions are pulsed from the ion source 43 with a trajectory 45 that is arranged at an inclination angle $\alpha$ to the X-axis. Each ion packet thus advances a distance $Z_R$ in the Z-direction for every ion mirror reflection. The positions of the ion packet at different times is represented by different groups of white circles 47. It can be seen that the ion packet starts at the ion source 43 and is reflected by the upper ion mirror 42 such that when the ion packet arrives at the middle Y-Z plane the ions are not displaced in the Y-direction. The ion packet then continues into the lower ion mirror 42 and is reflected such that when the ion packet arrives at the middle Y-Z plane the ions are displaced to a position $-Y_0$ in the Y-direction. The ion packet then continues into the upper ion mirror 42 for a second time and is reflected such that when the ion packet arrives at the middle Y-Z plane the ions are not displaced in the Y-direction. The ion packet then continues into the lower ion mirror 42 for a second time and is reflected such that when the ion packet arrives at the middle Y-Z plane the ions are displaced to a position $Y_0$ in the Y-direction. At this stage, the ion packet has performed four reflections in the ion mirrors and the ion packet has the same Y-displacement that it originally had at the ion source 43.

The ion packet then continues into the upper ion mirror 42 for a third time and is reflected such that when the ion packet arrives at the middle Y-Z plane the ions are not displaced in the Y-direction. The ion packet then continues into the lower ion mirror 42 for a third time and is reflected such that when the ion packet arrives at the middle Y-Z plane the ions are displaced to a position $-Y_0$ in the Y-direction. The ion packet then continues into the upper ion mirror 42 for a fourth time and is reflected such that when the ion packet arrives at the middle Y-Z plane the ions are not displaced in the Y-direction. The ion packet then continues into the lower ion mirror 42 for a fourth time and is reflected such that when the ion packet arrives at the middle Y-Z plane the ions are displaced to a position $Y_0$ in the Y-direction. The ion packet then continues into the upper ion mirror 42 for a fifth time and is reflected such that when the ion packet arrives at the middle Y-Z plane the ions are not displaced in the Y-direction. The ion packet then continues into the lower ion mirror 42 for a fifth time and is reflected such that when the ion packet arrives at the middle Y-Z plane the ions are displaced to a position $-Y_0$ in the Y-direction, at which they impact on the detector 44.

As described above, FIG. 4C shows a view of the embodiment in the Y-Z plane. The positions of the ion packets at different times that are illustrated by the white circles in FIG. 4B are also shown in FIG. 4C. As shown in FIG. 4C, the ion displacement in the Z-direction after each reflection in the ion mirror is $Z_R$. It can be seen that after the first ion mirror reflection the ion packet has only traveled a distance $Z_R$ is the Z-direction, which is smaller than the length of the ion source 43 in the Z-direction. If the ions had not been displaced in the Y-direction relative to their initial position, then after the first ion mirror reflection the trailing portion (in the Z-direction) of the ion packet would have impacted on the ion source 43. However, as the ions have been moved in the Y-direction relative to their initial position at the ion source 43, they are able to bypass the ion source 43 and continue through the device. The second and third ion reflections also cause the ion packet to have Y-direction positions such that it is impossible for them to impact on the detector. It is only after the fourth ion mirror reflection that the ion packet has returned to its original Y-direction position, i.e. that of the ion source 43. However, at this stage, the ions have traveled a distance $4Z_R$ in the Z-direction, at which point the ion packet has traveled sufficiently far in the Z-direction that it is impossible for the ions to impact on the ion source 43.

This technique allows for a relationship wherein the length in the Z-direction of the ions source 43 (i.e. a length in the Z-direction of the initial ion packet 47) may be up to approximately $4Z_R$ without ions hitting the ion source 43 as they travel through the device. Oscillating the ion packets in the Y-direction therefore allows the length of the ion source 43 in the Z-direction to be increased, or the Z-distance traveled by the ions after each reflection $Z_R$ to be decreased, relative to arrangements wherein the ions are not oscillated in the Y-direction. Increasing the length of the ion source 43 or decreasing the length $Z_R$ have the advantages described above.

In a similar manner to that described above, the ion packets 47 may be made to bypass the "narrow" ion detector 44 for three reflections out of every four. In other words, the detector 44 may be located in the Y-direction such that it is impossible for the ions to impact the detector 44 for three out of four reflections due to the locations of the ions in the Y-direction. This allows the length of the detector 44 in the Z-direction to be increased relative to an arrangement in which ions are not oscillated in the Y-direction.

The ion packet may expand in the Z-direction as it travels through the device, due to its initial angular divergence and inaccuracies in the electric fields. In order to avoid this causing spectral confusion, stops 48 may be provided for blocking the passage of ions that are arranged at the Z-direction edges of the ion packet as it travels through the device. Any ions in the ion packet that diverge in the Z-direction by an undesirable amount may therefore impact on the stops 48 and hence be blocked by the stops 48 and prevented from reaching the detector 44.

It is of importance to note that ion packet expansion in the Z-direction is less critical as compared to in the prior art planar MR-TOF-MS instrument 11 shown in FIG. 1. In the prior art MR-TOF-MS instrument 11, both ion packet width $Z_S$ and packet Z-expansion dZ must be far shorter than the distance traveled in the Z-direction during each reflection $Z_R$. In contrast, the embodiments of the present invention 41 allows the use of a much longer ion source 43 and detector 44, with the length of the ion source $Z_S$ and the length of the detector $Z_D$ being up to approximately $4Z_R$. As such, it is relatively easy to maintain the ion packet expansion dZ relatively short as compared to the ion source and detector length ($dZ<Z_S \sim Z_D<4Z_R$). Ion losses on ion stops 48 may therefore be kept moderate.

Optionally, at least one of the ion stops 48 may be used as an auxiliary ion detector, for example, to sense the overall intensity of ion packets travelling through the device. This may be used, for example, to adjust the gain of main detector 44, For example, the ion signal from the auxiliary detector may be fed into a control system that controls the gain level of the main detector 44 based on the magnitude of the ion signal. If the ion signal from the auxiliary detector is relatively low then the control system sets the gain of the main detector 44 to be relatively high, and vice versa. Alternatively, the ion signal from the auxiliary detector may be fed into a control system that controls the angle of injection of the ions into the space between the mirrors, or controls a steering system that alters the ion trajectory of ions as they travel between the mirrors. For example, this may be achieved by the control system controlling the magnitude of a voltage applied to an electrode based on the ion signal from the auxiliary detector. These latter methods change the trajectories of ions moving between the mirrors and the control system may use the feedback from the auxiliary detector to ensure that the ion trajectories are along the desired trajectories. For example, the control system may control the ion trajectories until the auxiliary ion detector outputs its minimum ion signal, indicating that most ions are being transmitted between the mirrors, rather than impacting on the auxiliary detector.

Figure 4D:
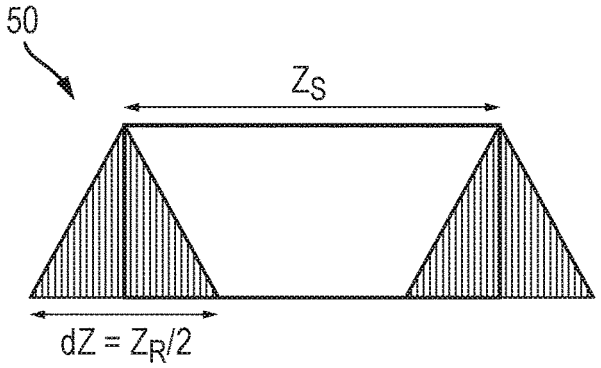

Assuming that the ion packet undergoes 16 ion mirror reflections, has an expansion in the Z-direction dZ of 30 mm by the time it reaches the detector 44, that $Z_R$ is 20 mm and that $Z_S=Z_D=60$ mm; then the MR-TOF-instrument of this embodiment would have a length in the Z-direction of just $Z_A=320$ mm, and an ion loss on stops 48 of only 20% (as seen in FIG. 4D). This is to be compared with the corresponding prior art example described above in relation to FIG. 1, which had a length in the Z-direction of $Z_A=800$ mm.

Thus, arranging the ions to oscillate in the Y-direction allows the ion packets to bypass the ion source 43 and ion detector 44 for a number of ion reflections and hence allows extension of the ion packets, ion source 43 and ion detector 44 in the drift Z-direction.

In the particular example of the ion mirror field described above, the Y-direction oscillation loop closes in four ion mirror reflections. However, it is contemplated that the Y-direction oscillation loop may close in a fewer or greater number of ion mirror reflections.

The techniques of the embodiments described above provide multiple improvements as compared to the prior-art planar MR-TOF-MS instrument 11. For example, the embodiments provides a notable reduction (at least two-fold) in the analyzer Z-direction length. This enables the ion path length of 16 m that is required for a resolution R~200, 000 to be provided in an instrument that is of practical size. The embodiments provide a significant ion source elongation (5-10 fold), thus improving the duty cycle of pulsed ion converters, which are estimated below as 5-20%, depending on the converter type. The embodiments enable ion packets to be elongated in the Z-direction to 30-100 mm, which extends the space-charge limit of the analyzer. The embodiments enable the detector to be elongated to 30-100 mm, which extends the dynamic range and life time of the detector.

The method of oscillating ions in the X-Y plane brings a concern that a Y-direction displacement of the ions could cause either spatial or time of flight spreading of the ion packets, which may limit the resolution of analyzers having high order aberrations. This concern is addressed in the accompanying simulations, showing that analyzer geometries are capable of operating with Y-axis oscillations for realistic ion packets.

Figure 5A:
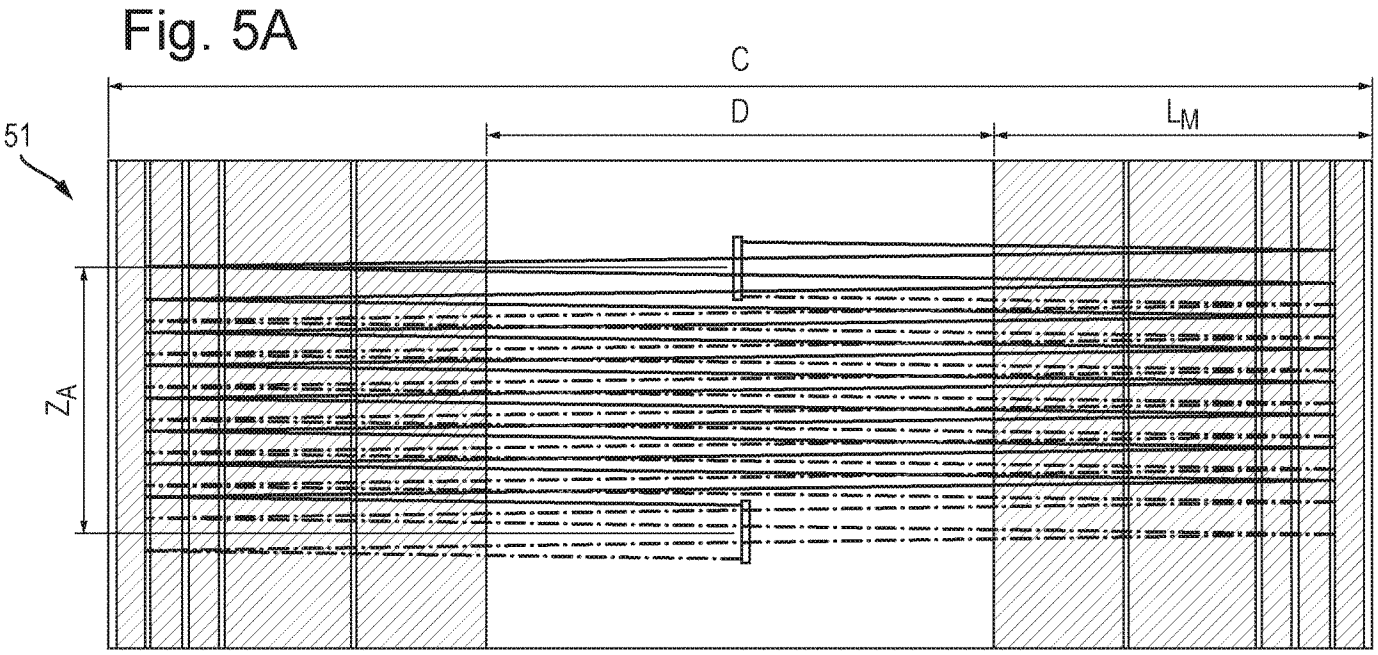
FIGS. 5A-5B show an example of gridless ion mirrors that are optimized for isochronous off-axis ion motion.

FIG. 5A shows the geometry of a planar MR-TOF-MS instrument 51 according to an embodiment of the present invention in the X-Z plane, and 5B shows one of the ion mirrors of this embodiment in the X-Y plane and the various voltages and dimensions that may be applied to the components of the instrument. In the embodiment modeled, the axial distribution of electrostatic potentials in the ion mirror 52 provides for a mean ion kinetic energy in the drift space between the mirrors of 6 keV. The mirrors have four independently tuned electrodes; three of them (the cap and two neighboring electrodes) may be set to retarding voltages and another (the longest in FIG. 5B) to an accelerating voltage. The total cap to cap distance C between opposing ion mirrors is about 1 m and the Y-height of the window within each mirror may be 39 mm. The ion injection angle $\alpha$ in the X-Z plane is set to 20 mrad, the initial Y-displacement of the ion trajectories is $Y_0$=5 mm, and the detector is arranged at a Y-displacement of $-Y_0$=5 mm.

FIG. 5A shows light and dark simulated ion trajectories. The light ion trajectories represent the ions emitted from the rear of the ion source (in the Z-direction), whereas the dark ion trajectories represent the ions emitted from the front of the ion source (in the Z-direction). The technique of oscillating the ions in the Y-direction allows both the ion source and ion detector to have a length of around 50 mm in the Z-direction (e.g., a source length of 50 mm and a detector length of 56 mm). As the ion source has a length in the Z-direction of 50 mm, the light and dark simulated trajectories are offset by almost 50 mm in the Z-direction. The total average distance traveled in the Z-direction during the 16 ion mirror reflections until the ions hit the detector is $Z_A$=280 mm. Accounting for Z-fringing fields of planar ion mirrors, this provides that the overall ion mirror length in the Z-direction needs to be approximately 420 mm, which is reasonable for commercial instrumentation.

Figure 5B:
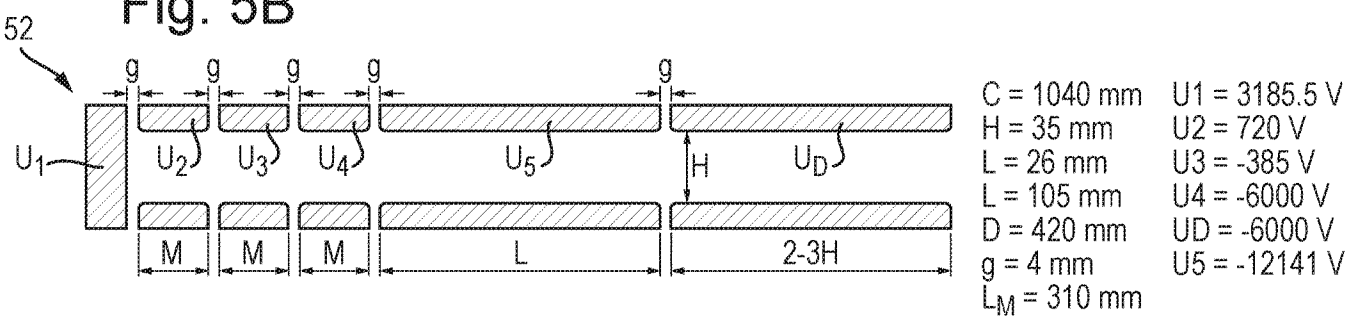
Figure 5C:
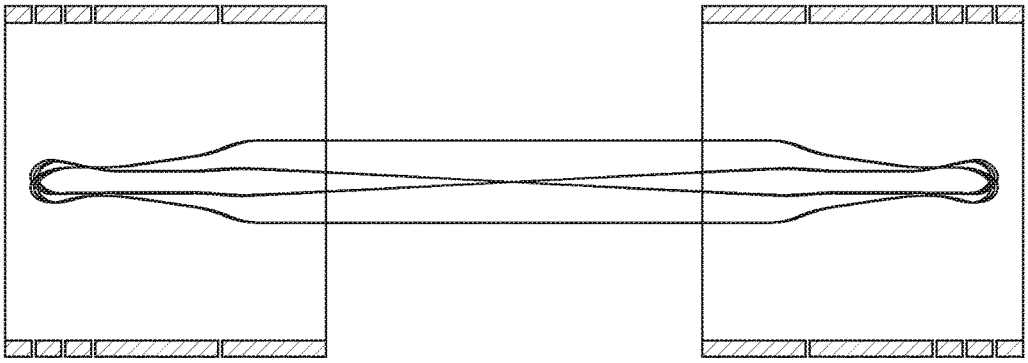
FIGS. 5C-5E show projections in the X-Y plane of example ion trajectories in the analyzer that are optimized for reducing flight time aberrations with respect to the spatial and energy spreads.
Figure 5D:
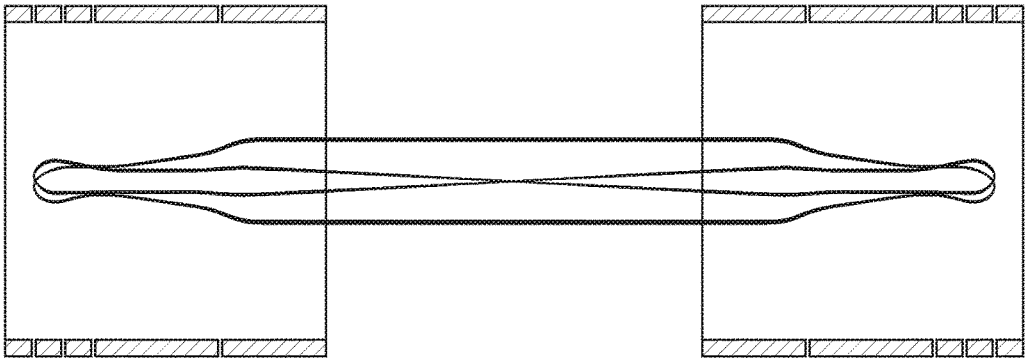
Figure 5E:
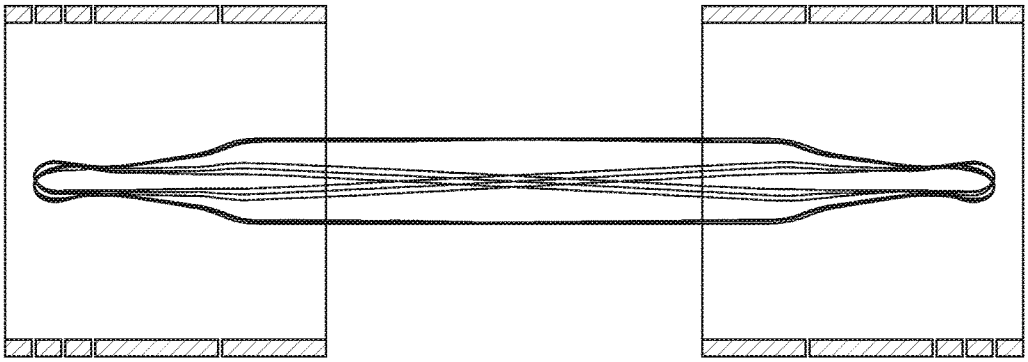

FIGS. 5C-5E show projections in the X-Y plane of example ion trajectories in the analyzer (the Y-scale is exaggerated) that are optimized for reducing flight time aberrations with respect to the spatial and energy spreads.

FIG. 5C shows ion trajectories with different ion energies. The ion mirrors may be tuned so as to eliminate the spatial energy dispersion in the middle of the analyzer after each reflection and thus to provide spatial achromaticity (i.e. the absence of coordinate and angular energy dispersion) after each two reflections. According to the general ion-optical theory (M. Yavor, Optics of Charged Particle Analyzers, Acad. Press, Amsterdam, 2009) such tuning provides for a first order isochronous ion transport with respect to spatial ion spread (i.e. dT/dY=dT/dB=0, where B=dY/dX is the inclination of ion trajectory).

FIG. 5D shows ion trajectories with different initial Y-coordinates. The ion mirrors may be tuned so as to provide a parallel-to-point focusing of the ion trajectories in the middle of the analyzer after one reflection, and consequently parallel-to-parallel focusing after each two reflections.

FIG. 5E shows ion trajectories with different initial B-angles of ion trajectories. The ion mirrors may be tuned so as to provide a point-to-parallel focusing of ion trajectories in the middle of the analyzer after one reflection, and consequently point-to-point focusing after each two reflections and the unity transformation after each four reflections. Overall, after each four reflections the spatial phase space of the ion packet experiences the unity transformation. According to the general ion-optical theory (D. C. Carey, Nucl. Instrum. Meth., v. 189 (1981) p. 365), tuning of the ion mirrors to satisfy only one additional condition $d^2Y/dBdK=0$, where K is the ion kinetic energy, leads to elimination of all second order flight time aberrations due to spatial (coordinate and angular) variations as well as to mixed spatial and energy variations after 16, 20, 24 . . . etc. reflections. The remaining dependence of the flight time with respect to the energy spread can be eliminated to at least the third aberration order ($dT/dK=d^2T/dK^2=d^3T/dK^3=0$) by a proper choice of electrode lengths and cap-to-cap distance.

Figure 6A:
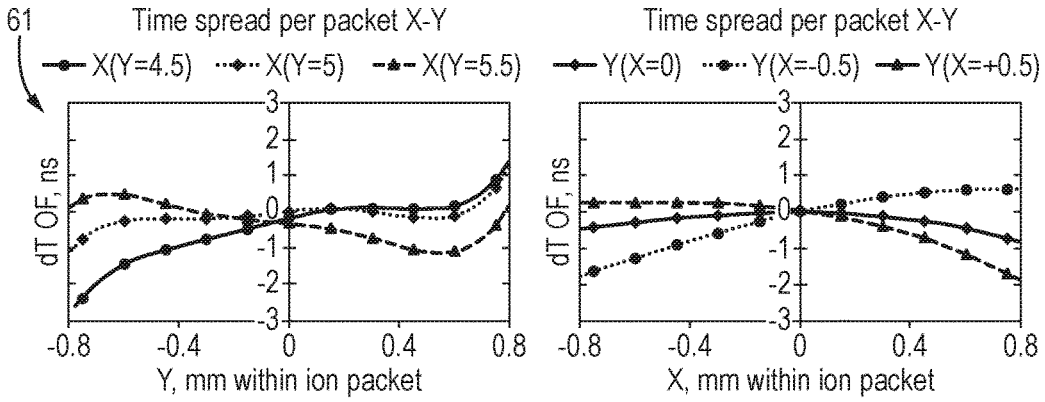
FIGS. 6A-6C show results of ion optical simulations for the analyzer of FIGS. 5A-5B.
Figure 6B:
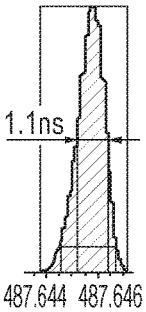
Figure 6C:
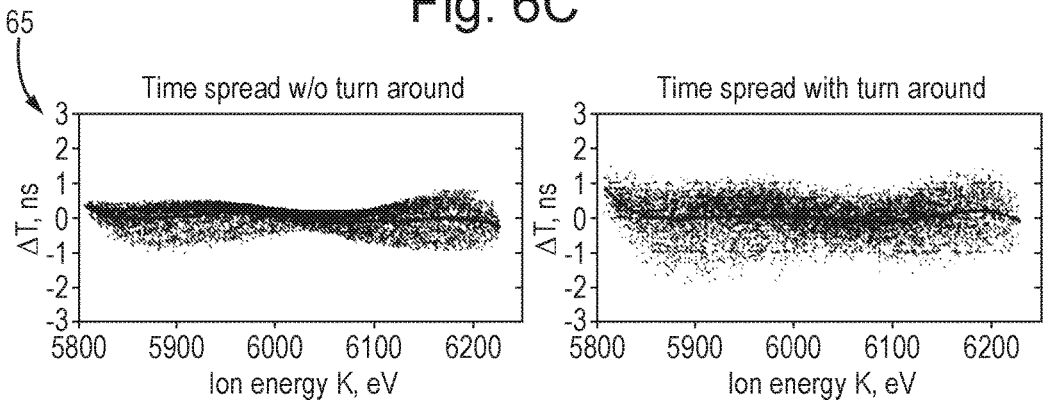

FIGS. 6A-6C show results of ion optical simulations for the analyzer shown in FIGS. 5A-5B, for the case of the ion packets produced by a 50 mm long orthogonal accelerator with an accelerating field of 300 V/mm from a continuous ion beam of 1.4 mm diameter with an angular divergence of 1.2 degrees and a beam energy of 18 eV. The resultant ion peak time width at the detector together with the time-energy diagram is shown and is characterized by a FWHM of 1.1 ns at a flight time of about 488 μs for ion masses of 1000 a.m.u., i.e. to mass resolving power of 224,000.

It should be understood that other numerical compromises can be used for improved resolution at smaller Y displacements or somewhat compromised resolution for larger Y displacement when meeting challenges at making narrow ion source or narrow detector.

Since MR-TOF-instrument aberrations generally grow with the amplitude of the Y-displacement of the ions during the oscillations, it is desirable to minimize the trajectory Y-offset $Y_0$. On the other hand, the minimal Y-offset should still be sufficient for differentiating axial trajectories and Y-displaced ion trajectories, defined by ion packet Y-width and Y-divergence. Besides, the minimal Y-offset has to be sufficient to bypass the ion source and/or detector during at least some of the oscillations (e.g., three Y-direction oscillations). In other words, depending on the ion injection scheme, the minimal Y-offset may depend on the physical width of the ion source and/or of the detector. In order to maintain a moderate Y-displacement of the ion packets while bypassing ion packets around the ion source, a number of methods may be used according to the present invention. For example, the ion source may be narrow, e.g., the ion source may be an orthogonal accelerator (OA) having a DC accelerator formed by resistive boards. Alternatively, the ion packets may be injected via a curved isochronous sector interface having a curvature in the X-Y plane. Alternatively, or additionally, there may be employed a pulsed deflector that deflects ions in the Y-direction so as to reduce the displacement of the ion packet compared to half the width of the orthogonal accelerator.

In order to avoid the detector interfering with bypassing ion trajectories the detector may comprise an ion to electron converter, which may have a smaller rim size than standard TOF detectors. The secondary electrons produced by the detector may be focused (for smaller spot in fast detectors) or defocused onto a detector (for longer detector life time) by either non-uniform magnetic or electrostatic fields.

Figure 7A:
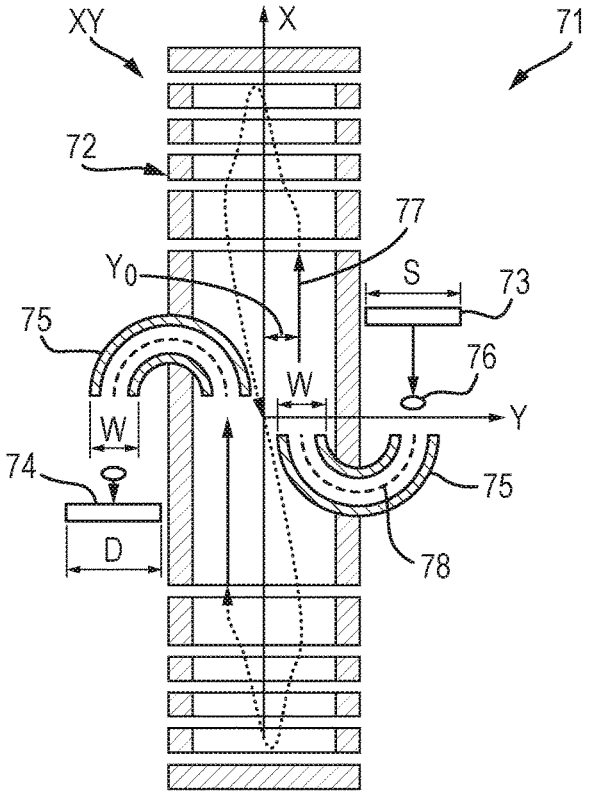
FIGS. 7A-7B show two and three-dimensional schematic views of an MR-TOF-MS according to another embodiment of the present invention, wherein electric sectors are used to inject and extract the ions from the time of flight region.
Figure 7B:
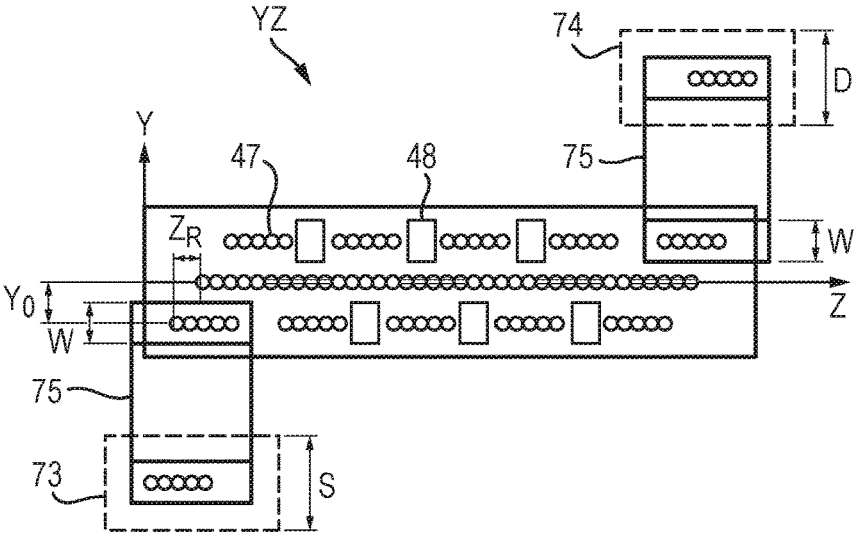

FIGS. 7A and 7B show an embodiment of an MR-TOF-MS instrument that is the same as that shown in FIGS. 4A-4D, except that isochronous electrostatic sectors 75 are used to inject and extract ions from the time of flight region. FIG. 7A shows a view in the X-Y plane and FIG. 7B shows a view in the Y-Z plane. The instrument 71 comprises a planar MR-TOF analyzer 72 comprising a relatively wide ion source 73 of width S arranged outside of the time of flight region, a relatively wide ion detector 74 of width D arranged outside of the time of flight region, and isochronous electrostatic sectors 75 of width W for interfacing the ion source 73 and ion detector 74 with the time of flight region. The curved ion trajectories 78 of the sectors 75 lie within the X-Y plane of the analyzer 72.

In operation, packets of ions 76 are accelerated from the ion source 73 into the entrance sector 75. The entrance sector 75 transfers the ion packets 76 from the ion source 73 into the analyzer 72 along the curved ion trajectory 78 so as to arrange the ion trajectory 77 within the analyzer parallel to the Y-axis at a Y-displacement $Y_0$ from X-Z middle plane. This arrangement enables the ions to be injected into the analyser 72 having a Y-displacement $Y_0$ that is more easily controllable than the Y-displacement provided by arranging the ion source in the flight region of the analyser (e.g., as in FIGS. 4A-4B). For example, when using an ion source having a relatively wide width in the Y-direction, it may be difficult to arrange the ion source inside the flight region of the analyser such that the ions have the desired initial $Y_0$ displacement and such that the ions do not impact on the ion source as they travel along the device. For example, in the embodiment shown in FIG. 4A-4B ions are emitted from the centre of the ion source (in the Y-direction) and so the initial displacement $Y_0$ cannot be made smaller than the half width (in the Y-direction) of the ion source without the ions later impacting on the ion source. In contrast, it can be seen from FIGS. 7A-7B that the use of sectors 78 enable the initial displacement $Y_0$ to be notably smaller than the half-width S/2 of the ion source and the half-width of the detector D/2.

In order to avoid the ions impacting on the sectors 75, the half-width in the Y-direction (W/2) of each of the sectors is arranged to smaller than $Y_0$.

Isochronous properties of sector interfaces 75 have been described in WO 2006/102430, incorporated herein by reference. The use of the sector interfaces 75 decouple the amplitude of $Y_0$ trajectory displacement from the physical width S and D of the ion source 73 or detector 74 at moderate time dispersion.

FIG. 7B corresponds to FIG. 4C, except that the isochronous electrostatic sectors 75 are used to inject and extract ions from the time of flight region. FIG. 7B shows projections of the ion source 73, ion receiver 74 and of the curved sectors 75. Groups of circles 47 represent the different locations of an ion packet crossing Y-Z middle plane at different times. As described previously, the ion stops 48 may be provided to remove portions of the ion packets that diverge excessively. Also, as described previously, one or more of the stops 48 may be an auxiliary detector for optimizing ion beam transmission through the analyzer 72, or as an auxiliary detector for automatic gain adjustment of the main detector 74.

Figure 8B:
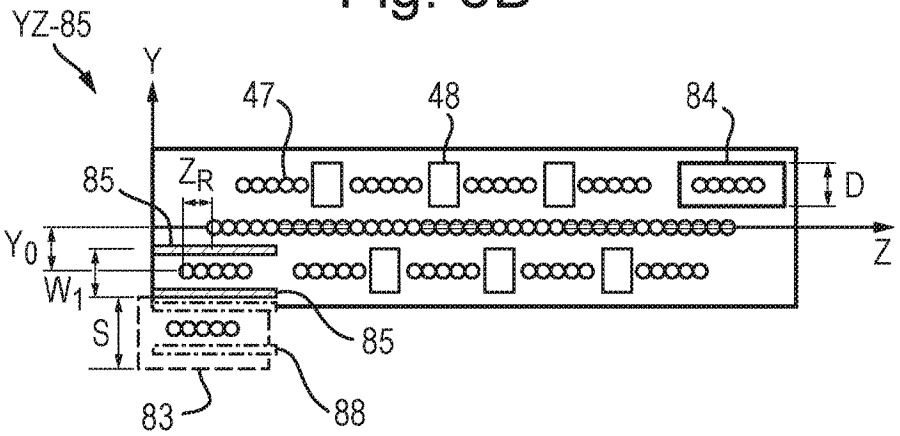
FIGS. 8A-8B show two and three-dimensional schematic views of MR-TOF-MS instruments according to further embodiments of the present invention, wherein deflectors are used to control the initial trajectory of the ions.
Figure 8C:
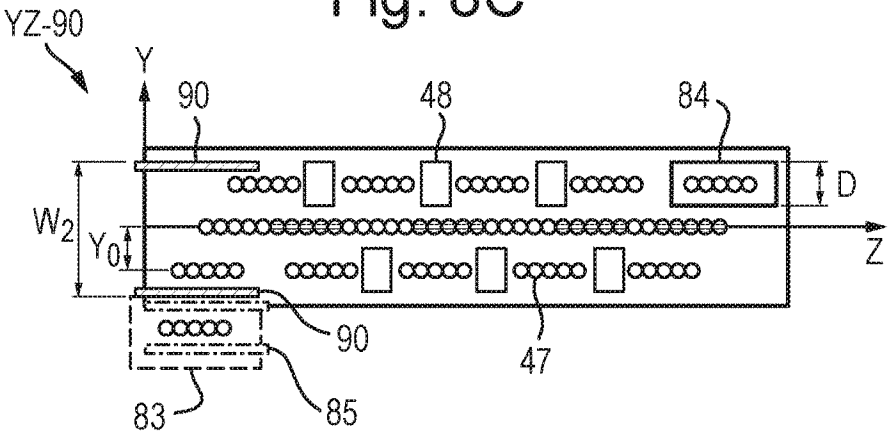
Figure 8A:
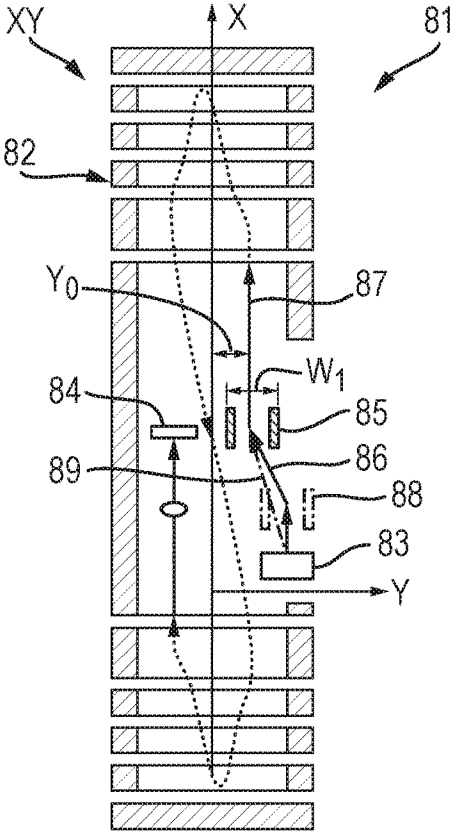

FIGS. 8A-8B show an embodiment of an MR-TOF-MS instrument that is the same as that shown in FIGS. 4A-4D, except that ion deflectors are used to inject ions along the desired trajectory. FIG. 8A shows a view in the X-Y plane and FIG. 8B shows a view in the Y-Z plane.

The instrument 81 comprises a planar MR-TOF analyzer 82 comprising a relatively wide ion source 83 of width S ($S>2Y_0$), a relatively narrow detector 84 of width D ($D<2Y_0$), a deflector 85 of width $W_1$, and an optional deflector 88. As in the previous embodiments, it is desired to inject the ions so that they initially travel parallel to the X-axis at a displacement from the X-axis of $Y_0$. As described previously, if the width of the source 83 in the Y-direction is greater than $2Y_0$ then the ions will impact on the ion source 83 as they travel through the device. The ion source 83 is therefore offset in the Y-direction so as to avoid interference with ion trajectory 87 after ion mirror reflections. Ions may then be directed from the ion source 83 towards the Y=0 plane and the deflector 85 may be used to deflect the ion trajectory so that the deflector 85 steers the ion packets along trajectory 87, parallel to the X-axis and at an offset of $Y_0$.

The ion ejection axis of the ion source 83 may be arranged to be parallel to the X-axis and an additional ion deflector 88 may be provided to steers the ion packets along trajectory 86 towards deflector 85, such that the Y-displacement of the ions becomes equal to $Y_0$ at the center of the deflector 85. The deflector 85 then steers the packets along the trajectory 87. Alternatively, the ejection axis of the ion source 83 may be tilted in the X-Y plane so as to eject the ion packets along trajectory 89 towards deflector 85, such that the Y-displacement of the ions becomes equal to $Y_0$ at the center of the deflector 85. The deflector 85 then steers the packets along the trajectory 87. Deflector 85 and/or 88 may be either a pulsed or static deflector.

Multiple other arrangements of pulsed or static deflectors are viable to transfer ion packets along the displaced trajectory 87 while avoiding their interference with moderately wide ion sources having a Y-direction width S above $2Y_0$.

FIG. 8C shows a view in the Y-Z plane of an alternative embodiment that is the same as that shown in FIGS. 8A-8B, except that deflector 85 is replaced with a deflector 90 having a width that is greater in the Y-direction. The deflector 90 has the same function as deflector 85, except that the width $W_2$ of the deflector 90 is chosen to be above $2Y_0$, thereby providing an alternative way to avoid it interfering with ion trajectory 87 within the analyzer 82. In other words, the deflector comprises electrodes that oppose each other in the Y-direction, wherein the electrodes are arranged on opposing sides of the Y=0 plane, and wherein the distance of each electrode from the Y=0 plane is greater than $Y_0$. The deflector 90 operates in a pulsed manner so as to avoid ion packet distortions after the first ion mirror reflection.

Figure 9A:
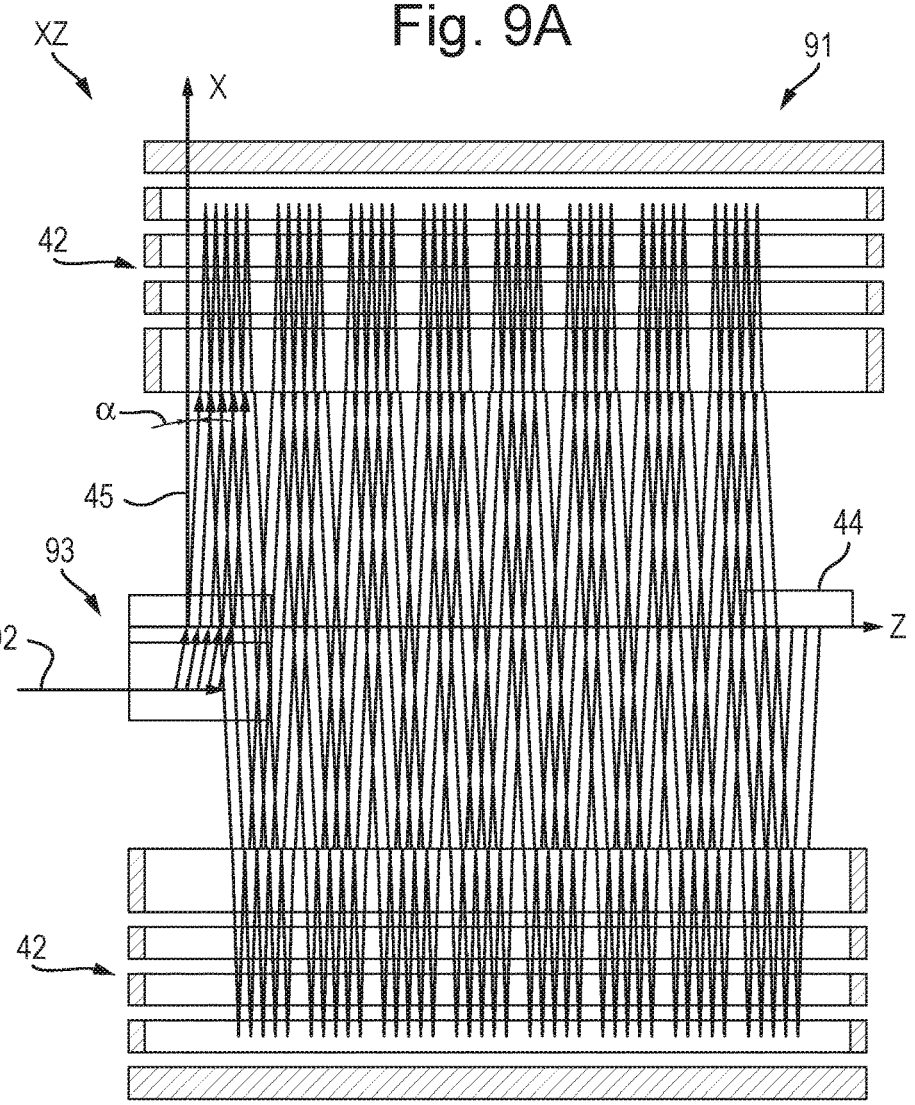
FIGS. 9A-9F show two and three-dimensional schematic views of an MR-TOF-MS according to another embodiment of the present invention, wherein various different types of pulsed converters are used to inject ions into the time of flight region.
Figure 9B:
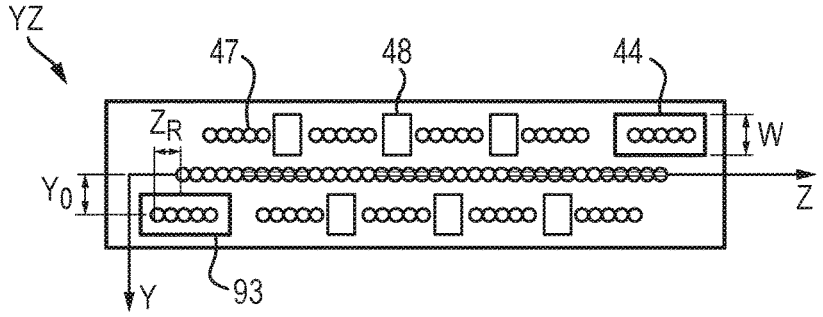

FIGS. 9A-9B show an embodiment of an MR-TOF-MS instrument that is the same as that shown in FIGS. 4A-4D, except that the ions source may be a pulsed converter 93 that periodically pulses a continuous beam 92, or a pulsed ion beam, into the ion mirrors. For example, the pulsed converter 93 may be an orthogonal acceleration device. FIG. 9A shows a view in the X-Y plane and FIG. 9B shows a view in the Y-Z plane. As with the ion source in the previously described embodiment, the pulsed converter 93 may be oriented substantially along the drift Z-direction with a converter length $Z_S$ being extended up to $4*Z_R$. The converter 93 may be gridless and may have a terminating electrostatic lens for providing a low divergence of a few mrad in the Y-direction.

Ion packets are produced by the pulsed converter 93 are injected into the time of flight region at a small inclination angle $\alpha$ to the X-axis. It is desired to optimize the angle $\alpha$ such that ion trajectories can be separated between groups of four reflections while maintaining a reasonable length of the analyzer in the Z-direction, e.g., $Z_A$~300-400 mm. The angle $\alpha$ of ion trajectories 45 may be optimized to ~20 mrad. The pulsed converter need not necessarily provide an optimal inclination angle of the ion trajectories and electrodes may be provides to steer the ion packets in order to achieve an optimal inclination angle $\alpha$~20 mrad.

Figure 9C:
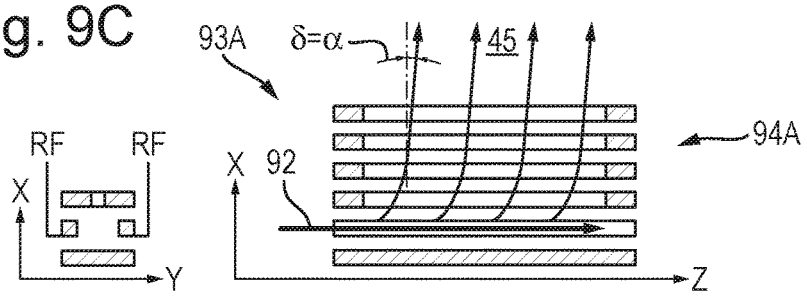

FIG. 9C shows a view in the X-Y plane and a view in the X-Z plane of a pulsed converter 93A comprising a radial ejecting ion trap used in a through mode. As shown in the X-Y view, the pulsed converter 93 comprises a pass-through rectilinear ion trap having top and bottom electrodes and side trap electrodes. A radiofrequency voltage signal is applied to the side trap electrodes in order to confine an ion beam 92. The ion beam is may be a relatively slow ion beam having an energy $K_Z$=3-5 eV. Periodically, the RF signal is switched off and electrical voltage pulses are applied to the top and bottom electrodes so as to extract an ion packet through a slit in the top electrode. Each ion packet is accelerated within DC accelerating stage 94A to an energy of, for example, $K_X$=5-10 keV. The ion packet has a natural inclination angle $\partial$, defined as $\partial=\mathrm{sqrt}(K_Z/K_X$, that is close to the desired inclination angle $\alpha$~20 mrad within the MRTOF analyzer.

As the ion beam 92 has a reduced energy (compared to orthogonal acceleration), the pulsed converter 93A provides an improved duty cycle, but additional ion losses on stops 48 may occur due to the ion packet expanding in the Z-direction. A numerical example will now be described. Let us assume that the continuous ion beam 92 has an average ion energy $K_Z$=5 eV, the energy spread in the Z-direction is $\Delta K_Z$=1 eV, and the length of the rectilinear trap Zs=80 mm (using notation as FIG. 4). Let us also assume that the MR-TOF analyzer has an acceleration energy $K_X$=8000 eV and that 16 ion mirror reflections are performed before the ions are detected. In this case, the average inclination angle is $\partial$=sqrt($K_Z/K_X$)=25 mrad, and the ion packet advance per ion mirror reflection is $Z_R$=25 mm at a cap to cap spacing of 1 m. The inclination angle spread is $\Delta\partial=\partial*\Delta K_Z/2K_Z$=2.5 mrad. After 16 ion mirror reflections the ion packet will drift in the Z-direction by a distance of $Z_A$=16 C*sin $\partial$=400 mm (using notation of FIG. 1) and will expand in the Z-direction by dZ=16 C*$\Delta\partial$=40 mm (using notation of FIG. 1). The accelerator length $Z_S$=80 mm (chosen to stay shorter than $4Z_R$) provides 20% duty cycle, while transmission TR through stops 48 is TR=0.8, as illustrated in the geometrical example 50 of FIG. 4D. Thus, the overall effective duty cycle is 16%. The trap 93A is an almost ideal converter, except that switching of the RF fields may present some problems with mass accuracy in the MR-TOF spectra.

Figure 9D:
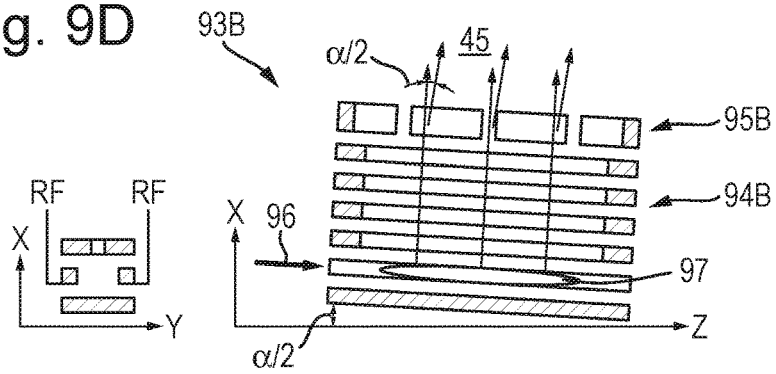

FIG. 9D shows a view in the X-Y plane and a view in the X-Z plane of a pulsed converter 93B comprising a radial ejecting ion trap used in an accumulating mode. As shown in the X-Y view, the pulsed converter 93 comprises a pass-through rectilinear ion trap having top and bottom electrodes and side trap electrodes. A radiofrequency voltage signal is applied to the side trap electrodes in order to confine a pulse injected ion beam 96 in radial directions. The trap comprises several segments of RF trap (not shown in the schematic view) and voltages are applied to these segments so as to provide a DC well of ~1V in the Z-direction of the trap. The injected ions are trapped and dampened in gas collisions, for time T and at gas pressure P, wherein the product of P*T may be approximately 3-5 ms*mTor. Typical pressures P may be 2-3 mTor and typical times T may be 1-2 ms. Periodically, the RF signal is switched off and electrical pulses are applied to the top and bottom electrodes so as to extract ion packets through the slit in the top electrode. The ion packets may be accelerated within a DC accelerating stage 94A to an energy of $K_X$=5-10 keV, at a natural inclination angle $\partial$ of zero. In order to arrange for the angle $\alpha$~20 mrad without notable time aberrations, the trap and DC accelerator 94B are tilted to an angle $\alpha/2$~10 mard from the Z-direction and a segmented deflector 95B (arranged in multiple segments for a uniform deflection field at small Y-width of the deflector) is used to deflect ion packets at an angle of $\alpha/2$~10 mrad.

The product of the trap 93B length $Z_S$ and steering angle $\alpha/2$ should be under 500 mm*mrad to maintain the T|ZK time aberration under a FWHM of 1 ns at a relative energy spread of ion packets matching the energy tolerance of the MRTOF analyzer $\Delta K_X/K_X$=6%. Thus, the trap length $Z_S$ may be kept at 50 mm at an angle $\alpha/2$=10 mrad.

Although the accumulating trap converter provides unity duty cycle, the trap may rapidly overfill as an ion cloud of 1E+6 ions may be accumulated during a 1 ms accumulation period when using realistic modern ion sources, which have a productivity of 1E+9 to 1E+10 ions per second. This problem may be partially solved by using controlled or alternating ion injection times. The elongated ion trap 93B having a length $Z_S$~50 mm still provides a much larger space-charge capacity than prior art axial ejecting traps that have a characteristic ion cloud size of 1 mm.

Figure 9E:
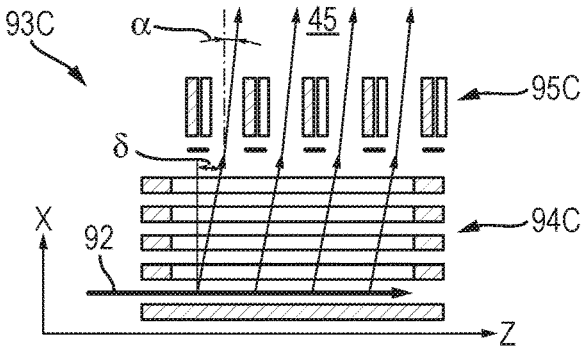

FIG. 9E shows a pulsed converter 93C comprising a conventional orthogonal accelerator with DC accelerating stage 94C aligned with the Z-axis and a multi-deflector 95C. The multi-deflector 95C comprises multiple deflection cells formed of thin (e.g., under 0.1 mm) and close lying deflection plates, optionally arranged on double sided printed circuit boards. Optionally, the Z-width of each deflection cell is about $Z_C$=1 mm. The orthogonal acceleration operation is known to be stable at ion beam 92 energies above 15 to 20 eV. The ion beam 92 may be set to have an energy of $K_Z$=20 eV, producing ion packets having an inclination angle $\partial$~50 mrad for $K_X$=8 keV. In order to arrange sixteen ion mirror reflections within a reasonable analyzer length in the Z-direction of up to 400 mm, the inclination angle is reduced to approximately $\alpha$~20 mrad. The multi-deflector 95C alters the angle of the ion packets by $\partial-\alpha$=30 mrad angle. At a cell width of $Z_C$=1 mm, the time fronts are tilted for an angle of $\partial-\alpha$ which expands the ion packets in the X-direction to $\Delta X=Z_C*\sin(\partial-\alpha)$ ~30 μm. At a flight path length of 16 m, the steering step imposes a limit of R<L/2ΔX~250,000 onto base peak mass resolution, i.e. approximately 500,000 resolution at FWHM. Thus, steering in a 1 mm cell multi-deflector is still able to obtain an overall resolving power of R~200,000. The overall duty cycle is estimated as 5-7%, depending on the accelerator length (accelerator length is limited to $Z_S$<60-70 mm for $Z_R$=20 mm) and on geometrical transmission of the multi-deflector.

Figure 9F:
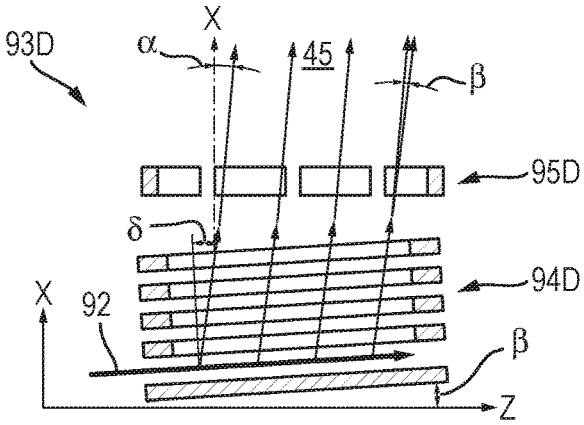

FIG. 9F shows a pulsed converter 93D comprising a conventional orthogonal accelerator 94D tilted at angle $\beta$~30 mrad to the Z-axis and a segmented deflector 95D. Several segments of the deflector 95D are arranged to provide a uniform deflection field at moderate Y-width of the deflector. A safe ion beam energy is chosen to be about 15-20 eV, resulting in a natural inclination angle of $\partial$~50 mrad. The deflector steering angle $\beta=\partial-\alpha$ is adjusted to equal to the tilting angle $\beta$ of the orthogonal accelerator in order to compensate for the first order time front inclinations (mutual compensation of tilting and steering time aberrations). The next notable time aberration T|$ZK_X$ appears since the steering angle depends on ion packet energy $K_X$. However, the second order aberration still allows a product of $z_S*\beta$ up to 500 mm*mrad for a relative energy spread of the ion packet of $\Delta K_X/K_X$=6% for keeping the FWHM of additional time spread under 1 ns, i.e. limits the resolution to R~200,000 at an orthogonal accelerator length up to 20-30 mm. The overall duty cycle is estimated to be 3-5%, which is still about 10 times better than in the prior art MR-TOF instruments.

Figure 10:
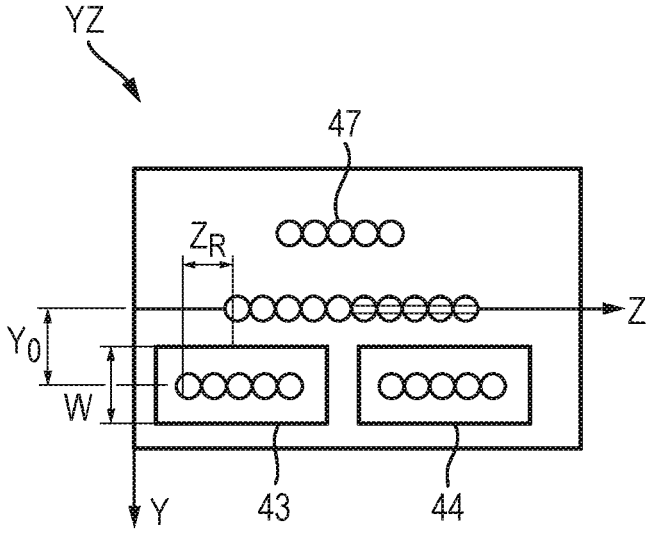

FIG. 10 a view in the Y-Z plane of an embodiment that is the same as that shown in FIG. 4C, except wherein the detector 44 is arranged so that the ions impact on the detector 44 after only four ion mirror reflections. This arrangement provides a relatively high duty cycle with a moderate resolution. By way of example, the cap to cap spacing in this arrangement may be C=1 m and the effective flight path may be 4 m (which is 1.6 times greater than in the current Q-TOF of Xevo XS). If the ion beam has a physical extent in the pusher, in the direction of push, of 1.2-1.4 mm, and the gradient in the pusher is 300 V/mm, then the energy spread Δk seen by the ions is approximately 420 eV for singly charged ions. The energy acceptance of such a device is given by Δk/k, where k is the acceleration voltage (e.g., 6000 V). This gives an energy acceptance of 6-7% whilst maintaining RA=100 K. Accordingly, a 1.2-1.4 mm beam may be used with a pusher gradient of 300 V/mm.

The present invention allows significant elongation of the ion accelerator in the Z-direction, for example, to 30-80 mm as compared to a length of 5-6 mm in prior art MR-TOF-MS instruments. The present invention therefore substantially improves the mass range and sensitivity the instruments with orthogonal accelerators.

Although the present invention has been described with reference to various embodiments, it will be understood by those skilled in the art that various changes in form and detail may be made without departing from the scope of the invention as set forth in the accompanying claims.

The invention claimed is:

1. A multi-reflecting time-of-flight mass spectrometer comprising:

two ion mirrors that are spaced apart from each other in a first dimension (X-dimension) and that are each elongated in a second dimension (Z-dimension) that is orthogonal to the first dimension;

an ion introduction mechanism for introducing packets of ions into the space between the mirrors such that they travel along a trajectory that is arranged at an angle to the first and second dimensions such that the ions repeatedly oscillate in the first dimension (X-dimension) between the mirrors as they drift through said space in the second dimension (Z-dimension);

wherein the mirrors and ion introduction mechanism are arranged and configured such that the ions also oscillate in a third dimension (Y-dimension), that is orthogonal to both the first and second dimensions, as the ions drift through said space in the second dimension (Z-dimension) such that the ions oscillate in the third dimension (Y-dimension) so as to perform an oscillation between positions of maximum amplitude of the oscillation;

wherein the spectrometer comprises an ion receiving mechanism arranged such that all ions, in each of the packets of ions, that are received by the ion receiving mechanism have oscillated the same number of times between the ion mirrors the first dimension (X-dimension); and wherein:

(i) at least part of the ion introduction mechanism is arranged between the mirrors, wherein at positions in the first and second dimensions (X- and Z-dimensions) of said at least part of the ion introduction mechanism, the at least part of the ion introduction mechanism extends over only part of the distance in the third dimension (Y-dimension) between said positions of maximum amplitude of the oscillation; and/or (ii) at least part of the ion receiving mechanism is arranged between the mirrors, wherein at positions in the first and second dimensions (X- and Z-dimensions) of said at least part of the ion receiving mechanism, the at least part of the ion receiving mechanism extends over only part of the distance in the third dimension (Y-dimension) between said positions of maximum amplitude of the oscillation.

2. The spectrometer of claim 1, wherein the ion mirrors and ion introduction mechanism are configured so as to cause the ions to travel a distance $Z_R$ in the second dimension (Z-dimension) during each reflection of the ions between the mirrors in the first dimension (X-dimension); and wherein the distance $Z_R$ is smaller than the length in the second dimension (Z-dimension) of said at least part of the ion introduction mechanism and/or of the length in the second dimension (Z-dimension) of said at least part of the ion receiving mechanism.

3. The spectrometer of claim 2, wherein the length in the second dimension (Z-dimension) of said at least part of the ion introduction mechanism and/or of the length in the second dimension (Z-dimension) of said at least part of the ion receiving mechanism is up to four times the distance $Z_R$.

4. The spectrometer of claim 1, wherein the ion mirrors and ion introduction mechanism are configured so as to cause the ions to oscillate at rates in the first dimension (X-dimension) and third dimension (Y-dimension) such that when the ions have the same position in the first and second dimensions (X- and Z-dimensions) as said at least part of the ion introduction mechanism, the ions have a different position in the third dimension (Y-dimension), such that the trajectories of the ions bypass said ion introduction mechanism at least once as the ions oscillate in the first dimension (X-dimension); and/or wherein the ion mirrors and ion introduction mechanism are configured so as to cause the ions to oscillate at rates in the first dimension (X-dimension) and third dimension (Y-dimension) such that when the ions have the same position in the first and second dimensions (X- and Z-directions) as said at least part of the ion receiving mechanism, the ions have a different position in the third dimension (Y-dimension), such that the trajectories of the ions bypass said ion receiving mechanism least once as they oscillate in the first dimension (X-dimension).

5. The spectrometer of claim 1, configured such that the ions oscillate in the third dimension (Y-dimension) about an axis with a maximum amplitude of oscillation, and wherein said at least part of the ion introduction mechanism, and/or said at least part of the ion receiving mechanism, is spaced apart from the axis in the third dimension (Y-dimension) by a distance that is smaller than the maximum amplitude of oscillation.

6. The spectrometer of claim 1, configured such that the ions oscillate in the third dimension (Y-dimension) about an axis of oscillation, and wherein either:

(i) said at least part of the ion introduction mechanism and said at least part of ion receiving mechanism are spaced apart from the axis in the third dimension (Y-dimension); or (ii) either one of said at least part of the ion introduction mechanism and said at least part of ion receiving mechanism is located on the axis, and the other of said at least part of the ion introduction mechanism and said at least part of ion receiving mechanism is spaced apart from the axis in the third dimension (Y-dimension); or (iii) both said at least part of the ion introduction mechanism and said at least part of the ion receiving mechanism are located on the axis.

7. The spectrometer of claim 1, wherein said at least part of the ion receiving mechanism is arranged between the mirrors for receiving ions from the space between the mirrors after the ions have oscillated one or more times in the third dimension (Y-dimension).

8. The spectrometer of claim 1, wherein the ion receiving mechanism comprises an ion guide and said at least part of the ion receiving mechanism is the entrance to the ion guide, further comprising an ion detector arranged outside of the space between the ion mirrors, wherein the ion guide is arranged and configured to receive ions from said space between the ion mirrors and to guide the ions onto the ion detector.

9. The spectrometer of claim 8, wherein the ion guide is an electric or magnetic sector.

10. The spectrometer of claim 1, wherein the ion receiving mechanism is an ion deflector for deflecting ions out of the space between the mirrors onto a detector arranged outside of the space between the ion mirrors.

11. The spectrometer of claim 1, wherein the ion introduction mechanism is a pulsed ion source arranged between the mirrors and configured to eject, or generate and emit, packets of ions so as to perform the step of introducing ions into the space between the mirrors.

12. The spectrometer of claim 11, wherein said pulsed ion source comprises an orthogonal accelerator or ion trap for converting a beam of ions into packets of ions.

13. The spectrometer of claim 1, wherein the ion introduction mechanism comprises an ion guide and said at least part of the ion introduction mechanism is the exit of the ion guide, further comprising an ion source arranged outside of the space between the ion mirrors, wherein the ion guide is arranged and configured to receive ions from said ion source and to guide the ions into said space so as to pass along said trajectory that is arranged at an angle to the first and second dimensions.

14. The spectrometer of claim 13, wherein the ion guide is an electric or magnetic sector.

15. The spectrometer of claim 1, wherein said at least part of the ion introduction mechanism is an ion deflector for deflecting the trajectory of the ions.

16. The spectrometer of claim 1, further comprising one or more beam stops arranged between the ion mirrors and in the ion flight path between the ion introduction mechanism and the ion receiving mechanism, wherein the one or more beam stops is arranged and configured so as to block the passage of ions that are located at the front and/or rear edge of each ion beam packet as determined in the second dimension (Z-dimension); and/or wherein each packet of ions diverges in the second dimension (Z-dimension) as it travels from the ion introduction mechanism to the ion receiving mechanism; and wherein one or more beam stops is arranged and configured to block the passage of ions in the ion packet that diverge from the average ion trajectory by more than a predetermined amount.

17. The spectrometer of claim 16, wherein at least one of the beam stops is an auxiliary ion detector, wherein the spectrometer comprises:

a primary ion detector arranged and configured for detecting the ions after they have performed a desired number of oscillations in the first dimension (X-dimension) between the mirrors and said auxiliary ion detector, wherein said auxiliary detector is arranged and configured to detect a portion of the ions in each ion packet; and a control system for performing at least one of:

controlling the gain of the primary ion detector based on the intensity detected by the auxiliary detector, or steering the trajectories of the ion packets based on the signal output from the auxiliary ion detector, optionally for optimising ion transmission from the ion introduction mechanism to the primary ion detector.

18. The spectrometer of claim 1, wherein the ion introduction mechanism comprises at least one voltage supply, electronic circuitry and electrodes; wherein the circuitry is configured to control the voltage supply to apply voltages to the electrodes so as to pulse ions into one of the ion mirrors at an angle or position relative to an axis of the mirror such that the ions oscillate in the third dimension (Y-dimension).

19. The spectrometer of claim 1, wherein the ion receiving mechanism is an ion detector and the spectrometer is configured to determine the mass to charge ratios of the ions from their time of flight from the ion introduction mechanism to the ion receiving mechanism.

20. A method of time-of-flight mass spectrometry comprising:

providing two ion mirrors that are spaced apart from each other in a first dimension (X-dimension) and that are each elongated in a second dimension (Z-dimension) that is orthogonal to the first dimension;

introducing packets of ions into the space between the mirrors using an ion introduction mechanism such that the ions travel along a trajectory that is arranged at an angle to the first and second dimensions such that the ions repeatedly oscillate in the first dimension (X-dimension) between the mirrors as they drift through said space in the second dimension (Z-dimension);

oscillating the ions in a third dimension (Y-dimension), that is orthogonal to both the first and second dimensions, as the ions drift through said space in the second dimension (Z-dimension) such that the ions oscillate in the third dimension (Y-dimension) so as to perform an oscillation between positions of maximum amplitude of the oscillation;

receiving the ions in or on an ion receiving mechanism after the ions have oscillated multiple times in the first dimension (X-dimension); wherein all ions, in each of the packets of ions, that are received in or on the ion receiving mechanism have oscillated the same number of times between the ion mirrors in the first dimension (X-dimension); and wherein:

(i) at least part of the ion introduction mechanism is arranged between the mirrors, wherein at positions in the first and second dimensions (X- and Z-dimensions) of said at least part of the ion introduction mechanism, the at least part of the ion introduction mechanism extends over only part of the distance in the third dimension (Y-dimension) between said positions of maximum amplitude of the oscillation; and/or (ii) at least part of the ion receiving mechanism is arranged between the mirrors, wherein at positions in the first and second dimensions (X- and Z-dimensions) of said at least part of the ion receiving mechanism the at least part of the ion receiving mechanism extends over only part of the distance in the third dimension (Y-dimension) between said positions of maximum amplitude of the oscillation.

* * * * *